US005998724A

United States Patent [19]

Takeuchi et al.

[11] Patent Number: 5,998,724

[45] Date of Patent: Dec. 7, 1999

[54] TONE SYNTHESIZING DEVICE AND METHOD CAPABLE OF INDIVIDUALLY IMPARTING EFFECT TO EACH TONE TO BE GENERATED

[75] Inventors: Chifumi Takeuchi; Toru Kitayama; Toshifumi Kunimoto, all of Hamamatsu, Japan

[73] Assignee: Yamaha Corporation, Hamamatsu, Japan

[21] Appl. No.: 09/176,513

[22] Filed: Oct. 21, 1998

[30] Foreign Application Priority Data

Oct. 22, 1997 [JP] Japan ..... 9-306347

[51] Int. Cl.[6] ..... G10H 1/02; G10H 7/00

[52] U.S. Cl. ..... 84/622; 84/604; 84/607; 84/625; 84/626; 84/659; 84/662

[58] Field of Search ..... 84/602, 604–607, 84/622–627, 630, 659–663

[56] References Cited

U.S. PATENT DOCUMENTS 5,256,830 10/1993 Takeuchi et al. .
5,272,274 12/1993 Kimura .
5,703,312 12/1997 Takahashi et al. ..... 84/626

*Primary Examiner*—Robert E. Nappi
*Assistant Examiner*—Marlon T. Fletcher
*Attorney, Agent, or Firm*—Graham & James LLP

[57] ABSTRACT

Basic tone waveform corresponding to a designated tone color and pitch is generated in each of a plurality of channels. Effect is imparted to the basic tone waveform in accordance with an algorithm for providing a predetermined effect, independently for each of the channels. The effect to be imparted is controlled in accordance with the designated tone pitch, separately for each of the channels. The effect impartment may be conducted using a processor, such as a DSP, executing a predetermined program containing a predetermined effect-imparting algorithm. In one example of the effect-imparting algorithm, a delay loop is employed through which an input exciting signal is circulated while being delayed, and an effect specific to an electromagnetic pickup of an electric guitar can be approximated by controlling the delay amount in the delay loop. In another example of the effect-imparting algorithm, a ransom signal is generated to control a cutoff frequency on the basis of the random signal, the basic tone waveform is filtered in accordance with the thus-controlled cutoff frequency, and the resultant filtered tone waveform is circulated through a delay loop whose delay amount is controlled in accordance with the designated tone pitch.

18 Claims, 21 Drawing Sheets

TONE SYNTHESIZING DEVICE AND METHOD CAPABLE OF INDIVIDUALLY IMPARTING EFFECT TO EACH TONE TO BE GENERATED

BACKGROUND OF THE INVENTION

The present invention generally relates to a tone synthesizing device and method which execute a program containing an effect algorithm and thereby synthesize a tone waveform having imparted thereto a particular effect as defined by the algorithm, as well as to a recording medium containing such a program.

To impart effects to polyphonically-generated tones, the conventional tone synthesizing devices first generate tone waveforms corresponding to respective notes of the desired tones and then mix together these tone waveforms to thereby provide a polyphonic tone waveform. Thereafter, the polyphonic tone waveform is fed to an effect circuit including a DSP (Digital Signal Processor), where a program containing a predetermined effect algorithm is executed to impart the polyphonically-generated tones an effect as defined by the algorithm.

The conventional tone synthesizing devices, however, could not separately or independently impart an effect to each of a plurality of tones that are to be generated in response to simultaneous depression of a plurality of keys, i.e., to each of notes constituting polyphonically-generated tones, on the basis of tonal characteristic (e.g., pitch and color) information specific to the note. Thus, with the conventional tone synthesizing devices, it was difficult, if not impossible, to achieve elaborate tone color creation or tone color control.

SUMMARY OF THE INVENTION

It is therefore an object of the present invention to provide a tone synthesizing device and method and a recording medium which achieve an increased variety of tonal effect, by separately imparting an effect to each of polyphonically-generated tones on the basis of tonal characteristic information specific to a note corresponding to that tone.

According to a first aspect of the present invention, there is provided a tone synthesizing device, which comprises: a tone designating section that designates a tone color and pitch of a tone to be generated; a basic tone waveform generator section that is capable of generating, in each of a plurality of channels, a basic tone waveform corresponding to the tone color and pitch designated by the tone designating section; an effect imparting section that imparts an effect to the basic tone waveform in accordance with an effect algorithm corresponding to the designated tone color, independently for each of the channels; and a control section that controls the effect, to be imparted by the effect imparting section, separately for each of the channels, the control section, for each of the channels, generating a unique effect control parameter in accordance with at least the designated tone pitch and controlling the effect for the channel in accordance with the effect control parameter generated thereby.

With this arrangement, an effect can be imparted to a tone synthesized in each of the channels, independently of a tone in the other channel; for example, different effects can be imparted respectively to different-color tones generated in two or more channels. Further, for each of the channels, different effect control can be executed depending on a tone pitch, by independently carrying out the effect control in accordance with a pitch of a tone to be generated in that channel.

In one implementation, the above-mentioned algorithm includes a delay element that delays an input exciting signal, and in order to impart an effect specific to an electromagnetic pickup of an electric guitar, the algorithm modifies a delay amount in the delay element in accordance with an assumed picking position and an assumed position of the electromagnetic pickup and controls the assumed picking position and assumed position of the electromagnetic pickup in accordance with the designated tone pitch. Thus, effects specific to a real electric guitar, which subtly differ between the individual strings and picking operations, can be approximated realistically.

In another implementation, the above-mentioned algorithm generates a random signal to control a cutoff frequency on the basis of the random signal, filters the basic tone waveform generated by the basic tone waveform generator section in accordance with the controlled cutoff frequency, supplies the filtered basic tone waveform to a delay element, and controls a delay amount in the delay element in accordance with the designated tone pitch. This arrangement can provide a water sound effect and also impart a feeling of pitch to the water sound, which would achieve a special effect.

The present invention can be arranged and practiced as a method invention as well as a device invention as mentioned above. Further, the present invention can be implemented as a computer program and as a recording medium containing such a computer program.

BRIEF DESCRIPTION OF THE DRAWINGS

For better understanding of the above and other features of the present invention, the preferred embodiments of the invention will be described in greater detail below with reference to the accompanying drawings, in which.

DETAILED DESCRIPTION OF THE PREFERRED EMBODIMENTS

Figure 1:
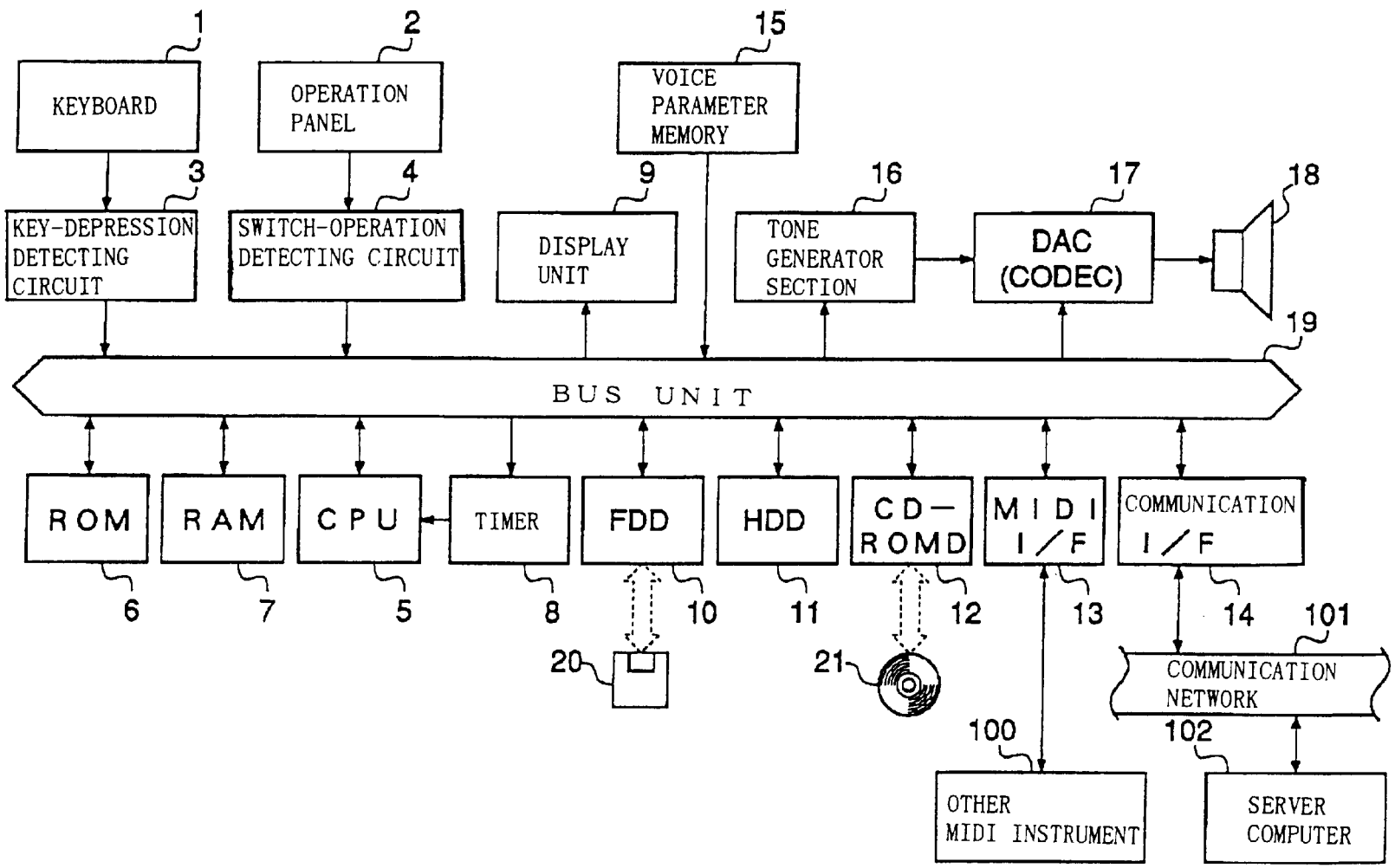
FIG. 1 is a block diagram showing an exemplary hardware setup of a tone synthesizing device in accordance with a preferred embodiment of the present invention.

FIG. 1 is a block diagram showing an exemplary hardware setup of a tone synthesizing device in accordance with a preferred embodiment of the present invention.

In the tone synthesizing device of FIG. 1, a keyboard 1 allows a player to enter pitch information and instruct generation of a tone having the pitch designated by the pitch information. Operation panel 2 is provided with a plurality of switches and operators to allow the user to enter various information such as data designating a desired tone color. Key-depression detecting circuit 3 detects respective operating states of the individual keys on the keyboard 1, and a switch-operation detecting circuit 4 detects respective operating states of the individual switches and operators on the operation panel 2. CPU 5 controls the overall operations of the tone synthesizing device. ROM 6 has stored therein various programs and data, such as control programs to be executed by the CPU 5 and table data. RAM 7 is provided for temporarily storing performance data, various input information, results of arithmetic operations and so forth.

The tone synthesizing device of FIG. 1 also includes a timer 8 for measuring various times such as interrupt timing in timer interrupt processes, and a display unit 9 provided with a large-size LCD (Liquid Crystal Display) or CRT (Cathode Ray Tube), LEDs (Light Emitting Diodes) and so forth. In addition, the tone synthesizing device includes one or more of a floppy disk drive (FDD) 10 for driving a floppy disk (FD) 20 as a recording medium, a hard disk drive (HDD) 11 for driving a hard disk (not shown) storing therein a variety of data and application programs including the above-mentioned control programs, and a CD-ROM drive (CD-ROMD) 21 for driving a compact disk read-only memory (CD-ROM) 21 storing therein a variety of data and application programs including the above-mentioned control programs.

The tone synthesizing device of FIG. 1 further includes a MIDI interface (I/F) 13 via which a MIDI (Musical Instrument Digital Interface) signal is received from or supplied to the outside, and a communication interface (I/F) 14 via which data is communicated with, for example, a server computer 102 through a communication network 101. In the tone synthesizing device, there are also provided a voice parameter memory 15 storing therein voice parameters as will be detailed later, a tone generator section 16 for generating tone signals on the basis of preset performance data or performance data entered via the keyboard 1 and imparting various effects to the thus-generated tone signals, a digital-to-analog converter or a so-called CODEC 17 for converting each of the digital tone signals from the tone generator section 16 into an analog tone signal, and a sound system 18 for sounding or audibly reproducing the analog tone signal from the DAC 17 via an amplifier and speaker.

The above-mentioned components 3 to 17 are interconnected via a bus unit 19. The timer 8 is connected to the CPU 5, another MIDI instrument 100 to the MIDI interface 13, the communication network 101 to the communication interface 14, the DAC 17 connected to the tone generator section 16, and the sound system 18 to the DAC 17.

The control programs for execution by the CPU 5 may be prestored in the hard disk installed within the hard disk drive 11 rather than in the ROM 2, in which case, by just loading the control programs from the hard disk into the RAM 7, the CPU 5 can operate in much the same way as where the control programs are stored in the ROM 6. This alternative arrangement using the hard disk will greatly facilitate version-up of the control programs, addition of a new control program and the like.

The control programs and various data read out from the CD-ROM 21 installed in the CD-ROM drive 12 are stored into the hard disk within the hard disk device 11. This alternative arrangement using the CD-ROM will also greatly facilitate version-up of the control programs, addition of a new control programs and the like. It will be appreciated that any other storage device than the CD-ROM drive 12 may be employed as an external storage device, such as a magneto-optical disk (MO) drive.

The communication interface 14 is connected to the communication network 101, such as a LAN (Local Area Network) and telephone line network, via which it can be connected with any other computers, such as the server computer 102, on the communication network 101. Thus, where the control programs and various parameters are not stored in the hard disk within the hard disk drive 11, the communication interface 14 is used to download these programs and parameters from the server computer 102. In such a case, a client computer (tone synthesizing device in the embodiment), sends a command requesting the server computer 102 to download the programs and parameters by way of the communication interface 14 and communication network 101. In response to the command, the server computer 102 delivers the requested control programs and parameters to the client computer via the communication network 101, and the client computer, in turn, receives and stores the control programs and parameters into the hard disk within the hard disk drive 11, to complete the necessary downloading of the programs and data. The tone synthesizing device may further include an interface for directly communicating data with external computers.

The voice parameter memory 15 may comprise any suitable recording medium, such as a ROM, RAM, floppy disk, hard disk or CD-ROM. Tone color data library (including voice data, DSP programs and so forth as will be described later), is stored within or outside the voice parameter memory 15, and the stored place of the tone color data library would vary depending on the recording medium used in the device as the voice parameter memory 15. For instance, where the voice parameter memory 15 comprises a RAM, the tone color data library is normally stored in a non-volatile recording medium (such as the above-mentioned ROM 6, floppy disk 20, CD-ROM 21 or magneto-optical or MO disk) and read out therefrom whenever necessary. Alternatively, the tone color data library may be placed somewhere on the communication network 101, such as in the above-mentioned server computer 102 or in another client's terminal.

In a situation where the CPU 5 has a high-speed processing capability, some of the functions of the tone generator section 16 may be assigned to the CPU 5 to thereby lessen the load of the tone generator section 16. In this case, the DAC 17 will receive a tone waveform from the CPU 5 by way of the bus unit 19. Further, it should be understood that the application of the present invention is not limited to a typical use as a tone synthesizing device in an electronic musical instrument, and the basic principle of the invention may also be applied to various amusement equipment such as game machines and "karaoke" apparatuses, various household electrical appliances such as television receivers, various computer devices and systems including personal computers, etc.

Figure 2A:
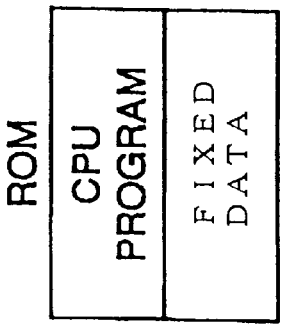
FIGS. 2A to 2D are diagrams showing memory maps of various memories employed in the embodiment of FIG. 1.
Figure 2C:
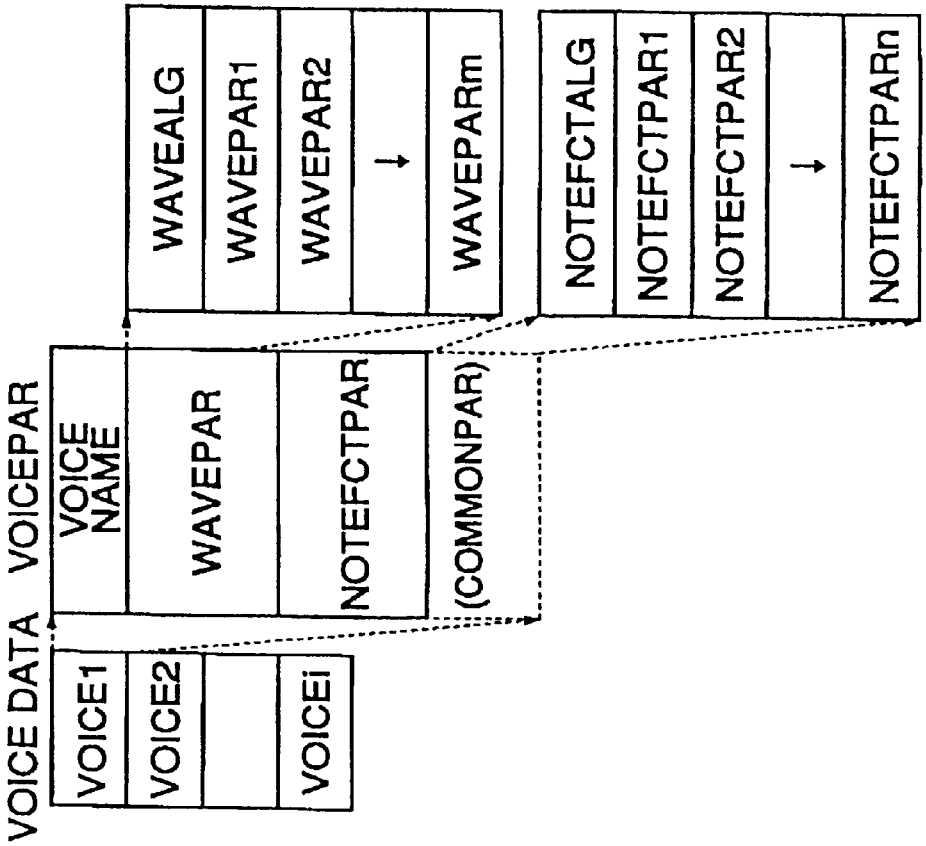
Figure 2D:
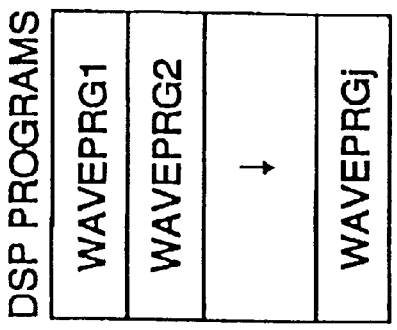
Figure 2B:
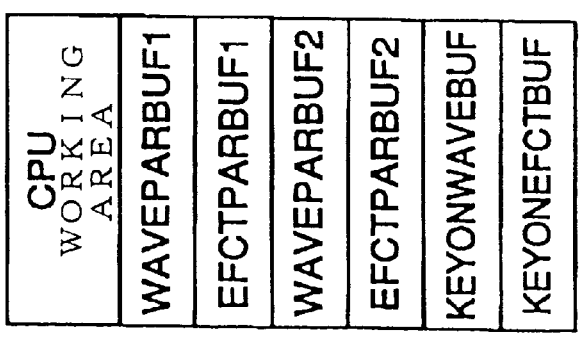

FIGS. 2A to 2D illustratively show memory maps of the various memories employed in the embodiment: FIG. 2A shows a memory map of the ROM 6; FIG. 2B a memory map of the RAM 7; and FIGS. 2C and 2D memory maps of the voice parameter memory 15. As shown in FIG. 2A, the ROM 6 includes a CPU program (PROGRAM) area and a fixed data area. The above-mentioned control programs for execution by the CPU 5 are prestored in the CPU program area, and the above-mentioned table data and various control data are prestored in the fixed data area.

As shown in FIG. 2B, the RAM 7 includes a CPU working area and a plurality of buffer areas. As noted earlier, performance data, various input information, results of arithmetic operations, etc. are temporarily stored in the CPU working area. The buffer areas include a first wave parameter buffer (WAVEPARBUF1) for storing a first group of wave parameters (parameters to determine a tone waveform to be sounded), a first effect parameter buffer (EFCTPARBUF1) for storing a first group of effect parameters, a second wave parameter buffer (WAVEPARBUF2) for storing a second group of wave parameters, and a second effect parameter buffer (EFCTPARBUF2) for storing a second group of effect parameters. The buffer areas also include a key-on wave buffer (KEYONWAVEBUF) that, when a tone generation (key-on) instruction is given by a player or user, stores contents of one of the wave parameter buffers, of the group corresponding to the key-on event, after the contents are modified on the basis of information relating to the key-on event such as a key code and touch intensity (e.g., velocity), and a key-on effect buffer (KEYONEFCTBUF) that stores contents of one of the effect parameter buffers, of the group corresponding to the key-on event, after the contents are modified on the basis of the key-on event information such as the key code and touch intensity (e.g., velocity). The reason why there are provided two similar sets of the buffers is that the tone synthesizing device according to the preferred embodiment is arranged to synthesize two tone waveforms in two processing systems thereof; although the "processing systems" corresponds to tone colors, the term "tone color" is not used here because a same tone color can also be assigned to the two processing systems.

The voice parameter memory 15 includes a voice data area for storing a plurality of voice data (VOICE1-i) as shown in FIG. 2C and a DSP program area for storing a plurality of DSP programs as shown in FIG. 2D. The DSP program area includes a wave program region and an effect program region, because each of the DSP programs comprises a wave program (WAVEPRG1-j) for generating a basic tone waveform and an effect program (NOTEFCTPRG1-k) for imparting an effect to the basic tone waveform.

Each of the plurality of voice data ("i" voice data) sets stored in the voice data area has a similar data format, and thus the following paragraphs representatively describe details of the first voice data set. As seen in FIG. 2C, the voice data set includes data indicative of a voice name thereof (VOICE NAME), wave parameter data (WAVEPAR) to be used for generating a tone waveform corresponding to the voice, effect parameter data (NOTEFCTPAR) to be used for imparting an effect corresponding to the voice, and common parameter data (COMMONPAR) such as a tone volume. Note that the common parameter data may be contained in the wave parameter data or effect parameter data, rather than stored in a separate storage area.

As also seen in FIG. 2C, the wave parameter data in the voice data set include wave algorithm data (WAVEALG) designating a wave algorithm for generating a basic tone waveform corresponding to the voice, and various wave parameters (WAVEPAR1-m) to be used in the designated wave algorithm. The effect parameter data include wave algorithm data (NOTEFCTALG) designating an effect algorithm for generating an effect to be imparted to the basic tone waveform corresponding to the voice, and various effect parameters (NOTEFCTPAR1-n) to be used in the designated effect algorithm.

As further seen in FIG. 2D, the wave program region in the DSP program area stores therein various wave programs (WAVEPRG1-j), each of which is designated by the above-mentioned wave algorithm data. The effect program region in the DSP program area stores therein various effect programs (NOTEFCTPRG1-k), each of which is designated by the above-mentioned effect algorithm data.

When the player designates a desired tone color for a specific processing system, a selection is made of the wave parameter data corresponding to the designated tone color. Thus, a wave program designated by the wave algorithm data in the wave parameter data is transferred to a program register, in the tone generator section 16, of a channel corresponding to the designated tone color, and various wave parameters (WAVEPAR1-m) included in the wave parameter data are stored into the first or second wave parameter buffer corresponding to the specific channel. Similarly, a selection is made of the effect parameter data corresponding to the designated tone color. Thus, an effect program designated by the effect algorithm data in the effect parameter data is transferred to a program register, in the tone generator section 16, of the channel corresponding to the designated tone color, and various effect parameters (NOTEFCTPAR1-n) included in the effect parameter data are stored into the first or second effect parameter buffer corresponding to the specific channel.

Then, once the user gives a key-on instruction for a specific channel, stored contents of the wave parameter buffer of the corresponding channel are modified on the basis of a key code, touch intensity and other data of the turned-on key. The thus-modified data are temporarily stored into the key-on wave buffer in the RAM and then transferred into a wave parameter register (which is provided for storing wave parameters) of the corresponding channel in the tone generator section 16. Similarly, stored contents of the effect parameter buffer of the corresponding channel are modified on the basis of the key code, touch intensity and other data of the turned-on key. The thus-modified data are temporarily stored into the key-on wave buffer in the RAM and then transferred into an effect parameter register (which is provided for storing effect parameters) of the corresponding channel in the tone generator section 16.

Figure 3:
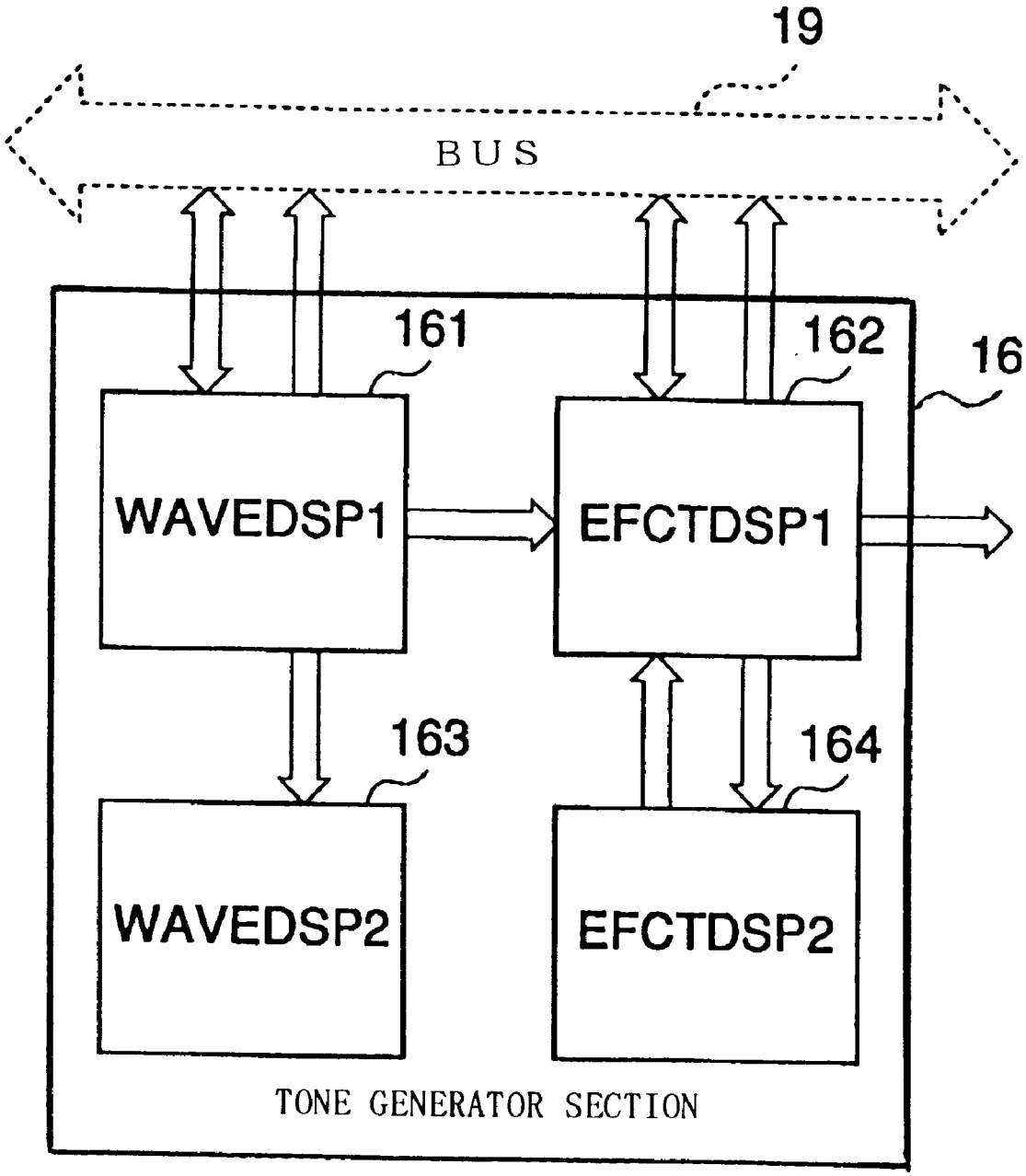
FIG. 3 is a block diagram showing an exemplary hardware setup of a tone generator section in the embodiment of FIG. 1.

FIG. 3 is a block diagram showing an exemplary hardware setup of the tone generator section 16. As shown, the tone generator section 16 includes a first wave DSP (WAVEDSP1) 161 for generating a first basic tone waveform (i.e., basic tone waveform for the first processing system), a first effect DSP (EFCTDSP1) 162 for imparting an effect to the first basic tone waveform, a second wave DSP (WAVEDSP2) 163 for generating a second basic tone waveform (i.e., basic tone waveform for the second processing system), and a second effect DSP (EFCTDSP2) 164 for imparting an effect to the second basic tone waveform.

The first wave DSP 161 is not only interconnected with the bus unit 19, but also connected to the first effect DSP 162 for effect impartment to the first basic tone waveform generated by the first wave DSP 161. Similarly, the second wave DSP 163 is not only interconnected with the bus unit 19, but also connected to the second effect DSP 164 for effect impartment to the second basic tone waveform generated by the second wave DSP 163.

Further, the first effect DSP 162 is interconnected with the bus unit 19 and connected to the above-mentioned DAC 17, and similarly the second effect DSP 164 is interconnected with the bus unit 19 and the first effect DSP 162. The reason why the output of the second effect DSP 164 is coupled to the first effect DSP 162 is that the first effect DSP 162 has, in addition to the function of imparting an effect to the basic tone waveform generated by the first wave DSP 161, a function of coupling (adding) together a first tone signal having the effect imparted thereto and an output signal from the second effect DSP 164, i.e., a second tone signal provided by imparting an effect to the second tone signal generated by the second wave DSP 163, and passing the added result to the DAC 17. Of course, the first and second effect DSPs 162 and 164 may each be arranged as a DSP only having the function of imparting an effect to the basic tone signal, and a separate adder may be provided for adding together the output signals from these effect DSPs 162 and 164.

Whereas the above-mentioned DSPs 161 to 164 have different functions as noted above, their hardware setups may be similar to each other, because the different functions are implemented via software. Therefore, the following paragraphs primarily detail the hardware setup of one of the DSPs.

Figure 4:
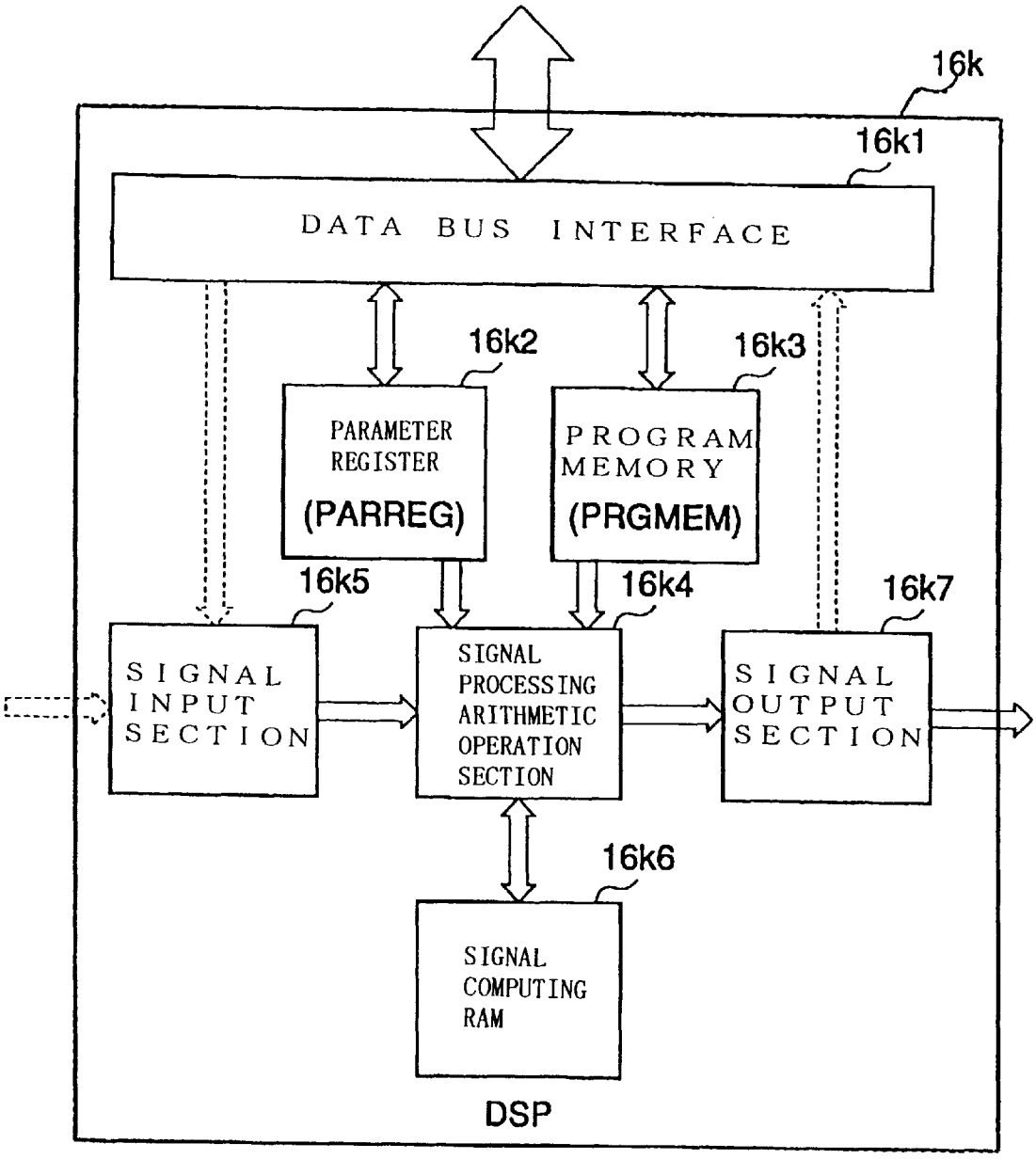
FIG. 4 is a block diagram illustratively showing a detailed hardware construction of one of four DSPs shown in FIG. 3.

FIG. 4 is a block diagram illustratively showing a detailed hardware construction of one of the four DSPs 161 to 164; the one DSP to be detailed here will be designated by a reference numeral **16*k* ("k" represents any one of integral numbers "1" to "4"). In the illustrated example of FIG. 4, the DSP 16*k* ("k" represents one of integral numbers "1"–"4") includes a data bus interface 16*k*1 for interfacing with a data bus of the bus unit 19, a parameter register (PARREG) 16*k*2 for storing parameters necessary for signal processing in the DSP 16*k*, a program memory (PRGMEM) 16*k*3 for storing a control program (the above-mentioned DSP program) descriptive of an operational sequence of the signal processing, and a signal processing arithmetic operation section 16*k*4 for carrying out various signal processing arithmetic operations on the basis of the control program stored in the program memory 16*k*3 and primarily with reference to the parameters stored in the parameter register 16*k*2. The DSP 16*k* further includes a signal input section 16*k*5 that receives a signal from the outside (external signal source) and passes the received signal to the signal processing arithmetic operation section 16*k*4 when some basic signal is necessary for the arithmetic operation section 16*k*4 to effect the signal processing arithmetic operations (e.g., the first effect DSP 162 uses the basic tone signal generated by the first wave DSP 161 in its signal processing). The DSP 16*k* also includes a signal computing RAM 16*k*6 for storing a temporary computed result during the course of the signal processing arithmetic operations, and a signal output section 16*k*7** for temporarily storing a final result of the signal processing arithmetic operations and outputting the thus-stored final result to the outside at predetermined timing.

The parameter register **16*k*2 and program memory 16*k*3 are both interconnected with the data bus interface 16*k*1 and connected to the signal processing arithmetic operation section 16*k*4. To the signal processing arithmetic operation section 16*k*4 are also connected the signal computing RAM 16*k*6 and signal output section 16*k*7. In the case of the second effect DSP 164, its signal input section 16*k*5 is connected to the data bus interface 16*k*1 and the signal output section 16*k*7 of the second wave DSP 163, and its signal output section 16*k*7 is connected to the data bus interface 16*k*1. It will be appreciated that the general behavior and signal-communicating operational sequence of the signal input and output section 16*k*5 and 16*k*7 in the second effect DSP 164** can be set in any desired manner by software or in response to instructions and parameters to the DSP.

Figure 5:
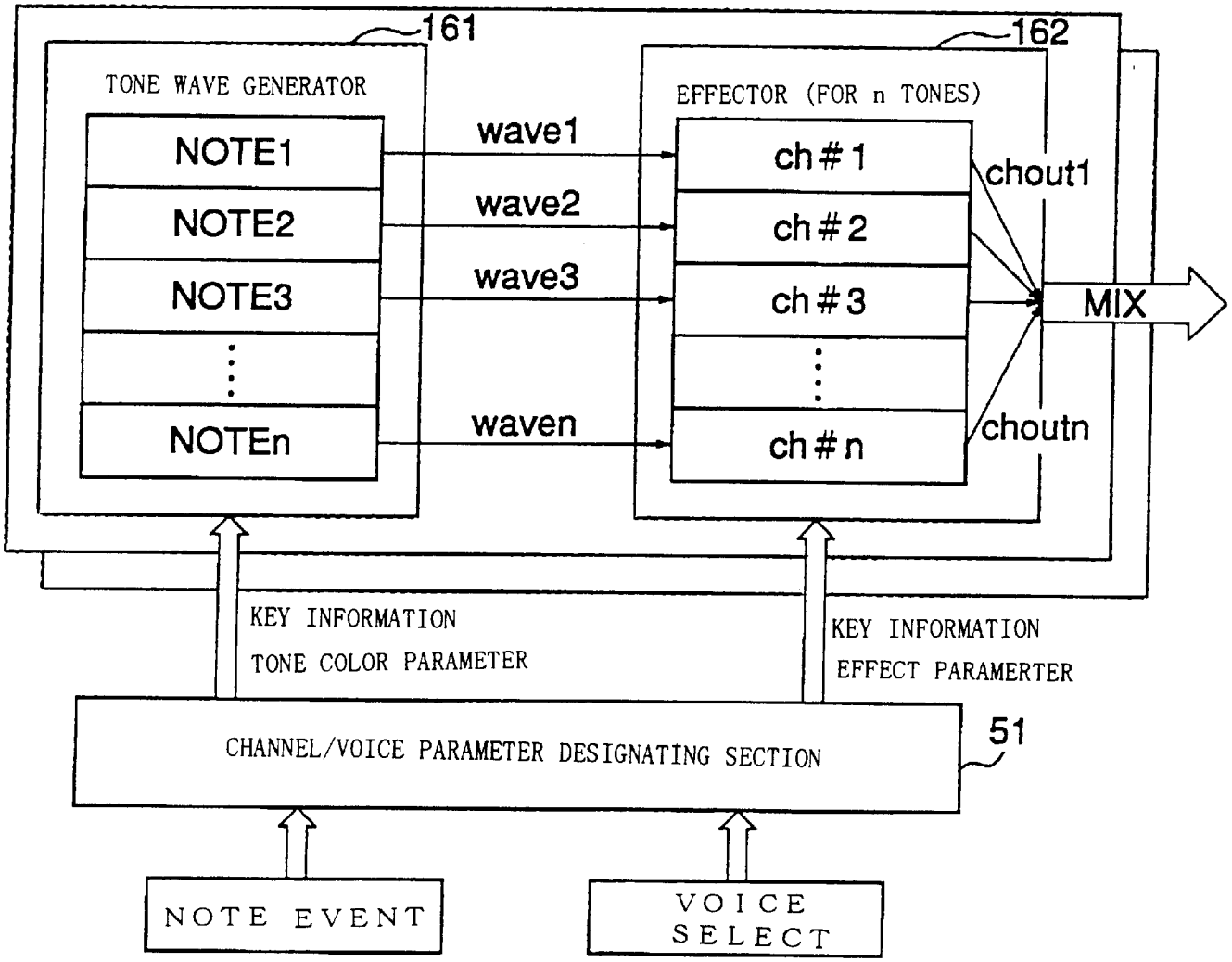
FIG. 5 is a block diagram explanatory of tone generation processing carried out by the tone generator section of FIG. 1.

FIG. 5 is a block diagram explanatory of tone generation processing carried out by the tone generator section 16. When the user selects a tone color (voice) by operating a predetermined one of the switches on the operation panel, corresponding voice select information is transmitted to a channel/voice parameter designating section 51. Similarly, when a note event occurs by the user depressing or releasing a key on the keyboard 1, corresponding note event information is transmitted to the channel/voice parameter designating section 51. In the illustrated example, the channel/voice parameter designating section 51 is implemented by the CPU 5; that is, operations carried out by the channel/voice parameter designating section 51 are part of the operations by the CPU 5.

The channel/voice parameter designating section 51 first detects one of the processing systems for which a key-on/off instruction has been given, and designates a particular tone generating channel to be used for generation of a designated tone if the given instruction is a key-on instruction, or identifies a tone generating channel being used for generation of a designated tone if the given instruction is a key-off instruction. Then, on the basis of the input voice select information and note event information, the channel/voice parameter designating section 51 generates key information including key-on/off event data, key code and touch data and also reads out the contents of the key-on wave and effect buffers stored in the above-mentioned manner. In addition, the channel/voice parameter designating section 51 sets the above-mentioned key information and read-out contents of the key-on wave buffer (i.e., tone color parameters) in a designated channel of the designated wave DSP 161 or 163 associated with the designated processing system, and also sets the above-mentioned key information and read-out contents of the key-on effect buffer (i.e., effect parameters) in a designated channel of the designated effect DSP 162 or 164 associated with the designated processing system.

Thus, a basic tone waveform wavek ("k" represents any one of integral numbers "1" to "n") is generated by the designated wave DSP 161 or 163 and sent to the effect DSP 162 or 164, which imparts an effect to the basic tone waveform to provide an effect-imparted tone waveform choutk. As previously noted, the effect-imparted tone waveforms choutk (k=1, . . . , n) of the individual processing systems are added together via the effect DSP 162 and sent to the DAC 17.

This embodiment is capable of generating eight tone waveforms (n=8), having a same color but different pitches, per processing system, and capable of synthesizing such tone waveforms in a total of two processing systems. Namely, if different colors are allocated to the individual processing systems, two-color tone waveforms can be polyphonically synthesized to provide up to eight tones per color, or if a same color is allocated to all of the processing systems, then single-color waveforms can be polyphonically synthesized to provide up to 16 tones.

Figure 6:
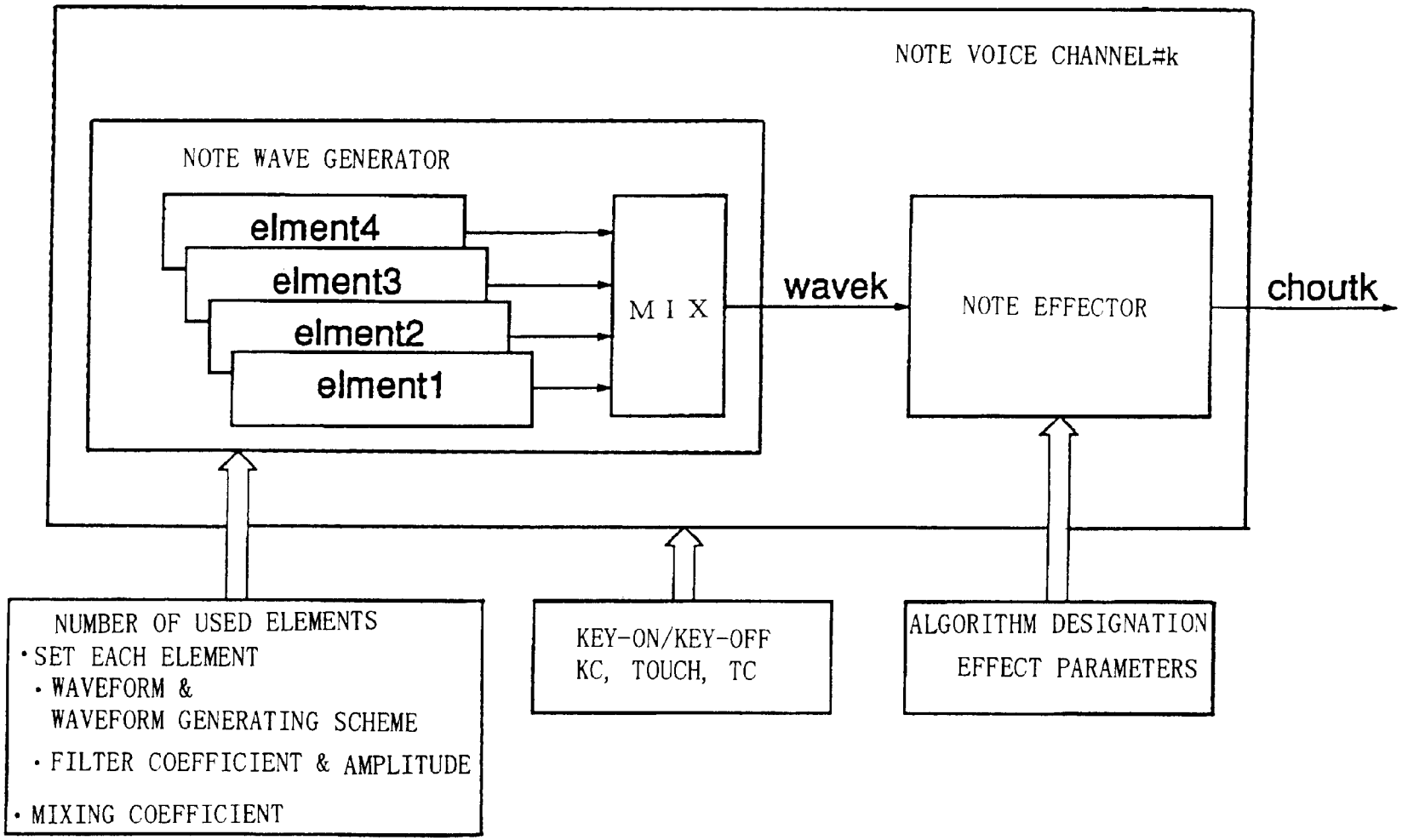
FIG. 6 is a diagram more fully explanatory of a manner in which a basic tone waveform and an effect-imparted output tone waveform of FIG. 5 are generated in a given channel.

FIG. 6 is a diagram more fully explanatory of the manner in which the basic tone waveform wavek and effect-imparted output tone waveform choutk are generated in the embodiment. This embodiment assumes that each individual tone comprises a plurality of elements (e.g., four elements), although some tones of course use only part of the elements rather than all of the elements.

In the illustrated example of FIG. 6, once the number of used elements, waveform generating schemes to be used for the individual elements, settings of filter coefficient and amplitude and mixing coefficients as well as key information are entered as tone color parameters, an initial tone waveform is generated for each of the elements on the basis of these entered tone color parameters. The initial tone waveforms thus generated for the individual elements are mixed together after being weighted in accordance with the mixing coefficients, so as to generate a basic tone waveform wavek. Now that an effect algorithm and effect parameters corresponding to the effect algorithm have been input to the effect DSP 162 or 164 as effect parameters, the generated basic tone waveform wavek is imparted an effect to provide an effect-imparted output tone waveform choutk.

Now, a detailed description will be given about various control executed by the tone synthesizing device arranged in the above-described manner, with reference to FIGS. 7 to 9.

Figure 7:
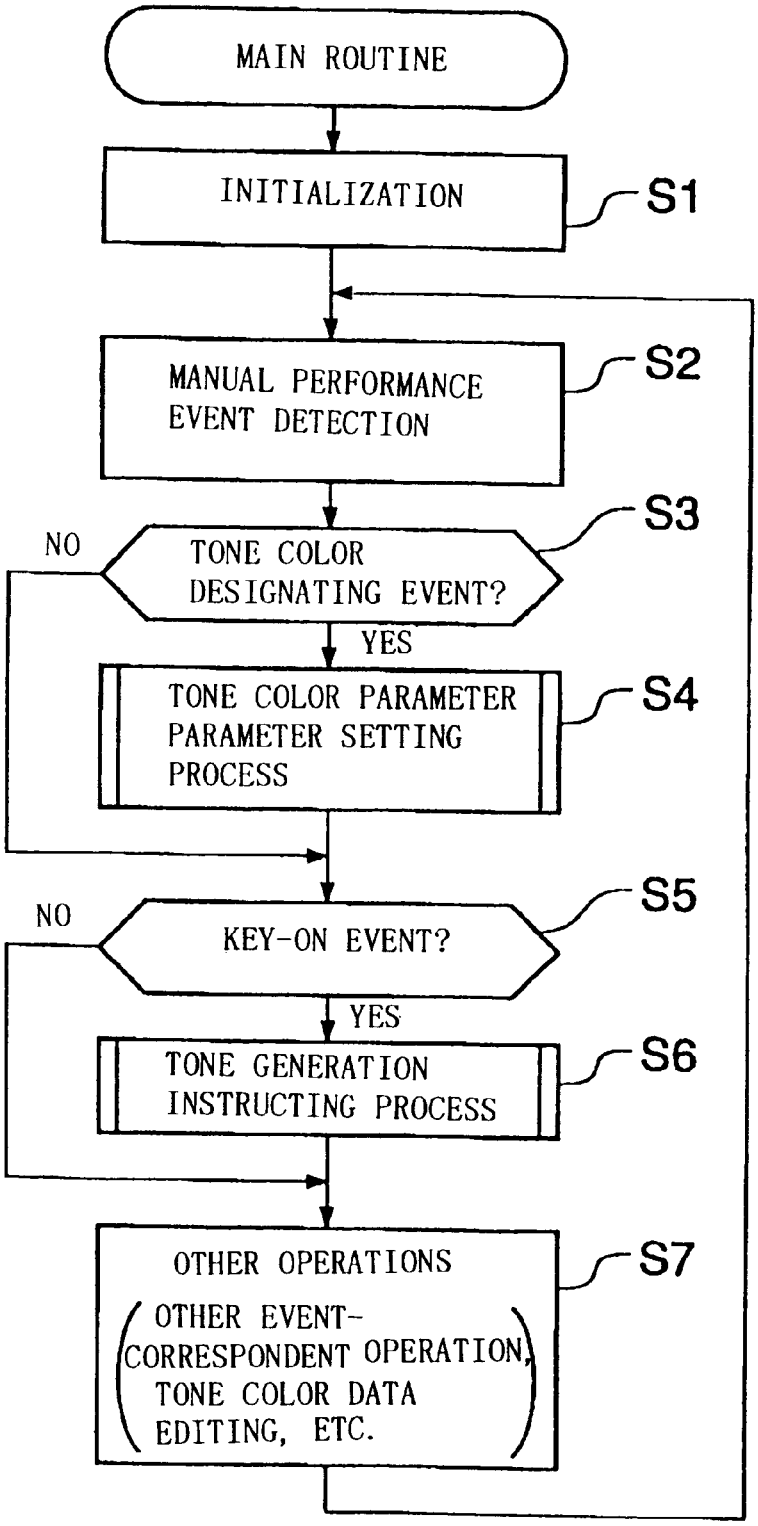
FIG. 7 is a flow chart of a main routine carried out by the tone synthesizing device of FIG. 1 and particularly by a CPU of the device.

FIG. 7 is a flow chart of a main routine carried out by the tone synthesizing device and particularly by the CPU 5 thereof. In the main routine, an initialization process is executed at step S1, which includes clearing the RAM 7. At next step S2, a manual performance event detecting operation is executed to ascertain whether or not any manual performance event has been caused to occur by the user operating the keyboard 1 or any of the switches on the operation panel 2. Then, a determination is made at step S3 as to whether or not the manual performance event detecting operation of step S2 has detected any tone color designating event. If the manual performance event detecting operation has detected a tone color designating event as determined at step S3, a tone color parameter setting process subroutine is carried out at step S4, as will be later detailed with reference to FIG. 8. If there has occurred no such tone color designating event, the main routine jumps over step S4 to step S5.

At step S5, a determination is made as to whether or not the manual performance event detecting operation of step S2 has detected any key-on event. If the manual performance event detecting operation has detected a key-on event as determined at step S5, a tone generation instructing process subroutine is carried out at step S6, as will be later detailed with reference to FIG. 9. If there has occurred no such key-on event, the main routine jumps over step S6 to step S7. Step S7 executes other operations, such as a tone deadening operation responsive to detection of a key-off event or other event-correspondent operation responsive to detection of another event and tone color data editing operation. After step S7, the main routine loops back to step S2 to repeat the above-mentioned operations at and after steps S2 step S7.

Figure 8:
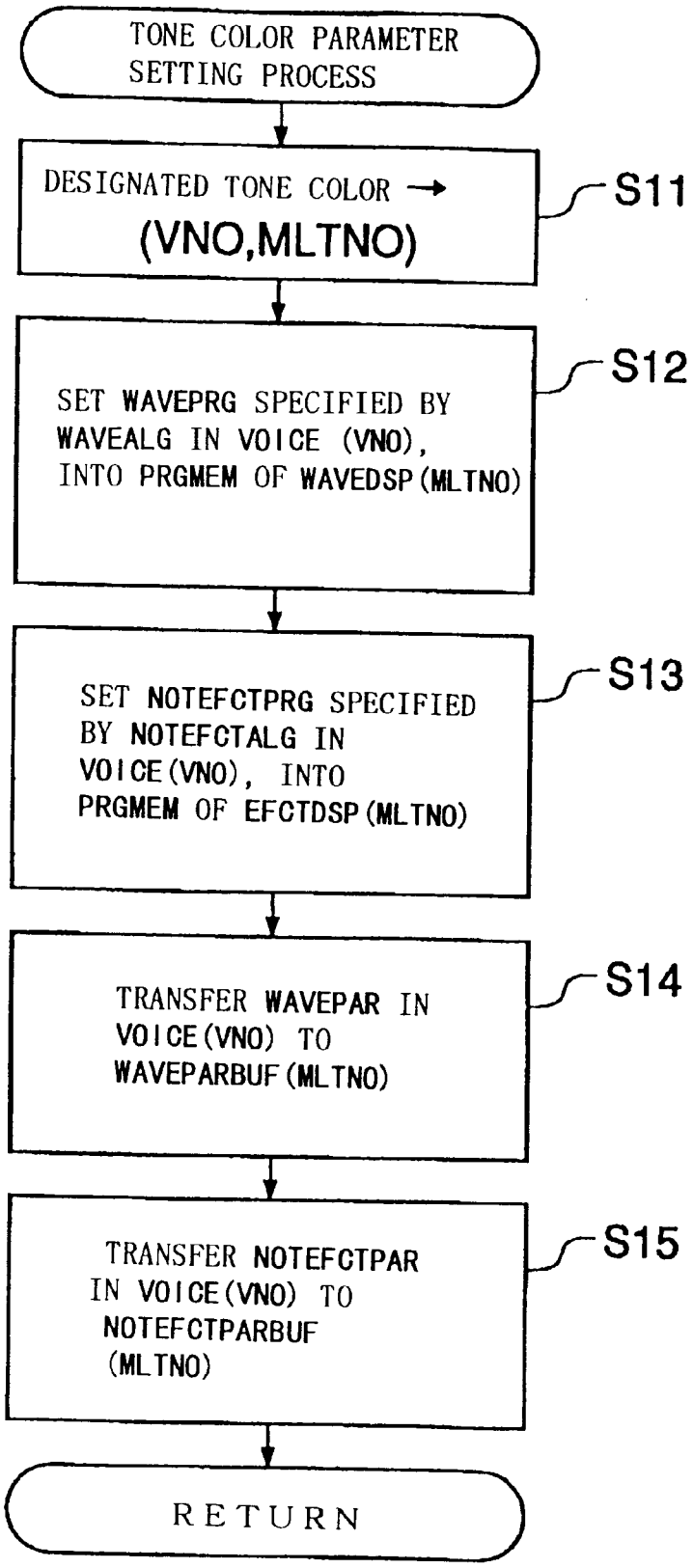
FIG. 8 is a flow chart showing a detailed step sequence of a tone color parameter setting process subroutine of FIG. 7.

FIG. 8 is a flow chart showing a detailed step sequence of the tone color parameter setting process subroutine of step S4. In the illustrated example of FIG. 8, a voice number and processing system number are identified, at step S11, from the tone color designating event data and stored into respective predetermined regions VNO and MLTNO of the RAM 7. Hereinafter, the stored contents of the regions VNO and MLTNO will be called a voice number VNO and processing system number MLTNO, respectively.

Then, at step S12, one of the wave programs (i.e., the wave programs WAVEPRG1-j shown in FIG. 2D) which is specified by the wave algorithm data WAVEALG in the voice data VOICE designated by the voice number VNO (VOICE(VNO)) (i.e., one of the voice data VOICE1-i shown in FIG. 2C) is read out and set into the program memory PRGMEM of the wave DSP specified by the processing system number MLTNO (WAVEDSP (MLTNO)), i.e., one of the wave DSPs 161 or 163. Similarly, at step S13, one of the effect programs (i.e., the effect programs NOTEFCTPRG1-k shown in FIG. 2D) which is specified by the effect algorithm data NOTEFCTALG in the voice data VOICE designated by the voice number VNO (VOICE(VNO)) is read out and set into the program memory PRGMEM of the effect DSP specified by the processing system number MLTNO (EFCTDSP(MLTNO)), i.e., one of the effect DSPs 162 or 164.

Then, at step S14, the wave parameter data WAVEPAR in the voice data VOICE designated by the voice number VNO (VOICE(VNO)) are read out and transferred to the wave parameter buffer specified by the processing system number MLTNO (WAVEPARBUF(MLTNO)), i.e., one of the first and second wave parameter buffers (WAVEPARBUF1 or WAVEPARBUF2) as shown in FIG. 2B. Similarly, at step S15, the effect parameter data NOTEFCTPAR in the voice data VOICE designated by the voice number VNO (VOICE (VNO)) are read out and transferred to the effect parameter buffer specified by the processing system number MLTNO (EFCTPARBUF(MLTNO)), i.e., one of the first and second effect parameter buffers (EFCTPARBUF1 or EFCTPARBUF2) as shown in FIG. 2B. After step S15, the tone color parameter setting process subroutine is terminated.

Figure 9:
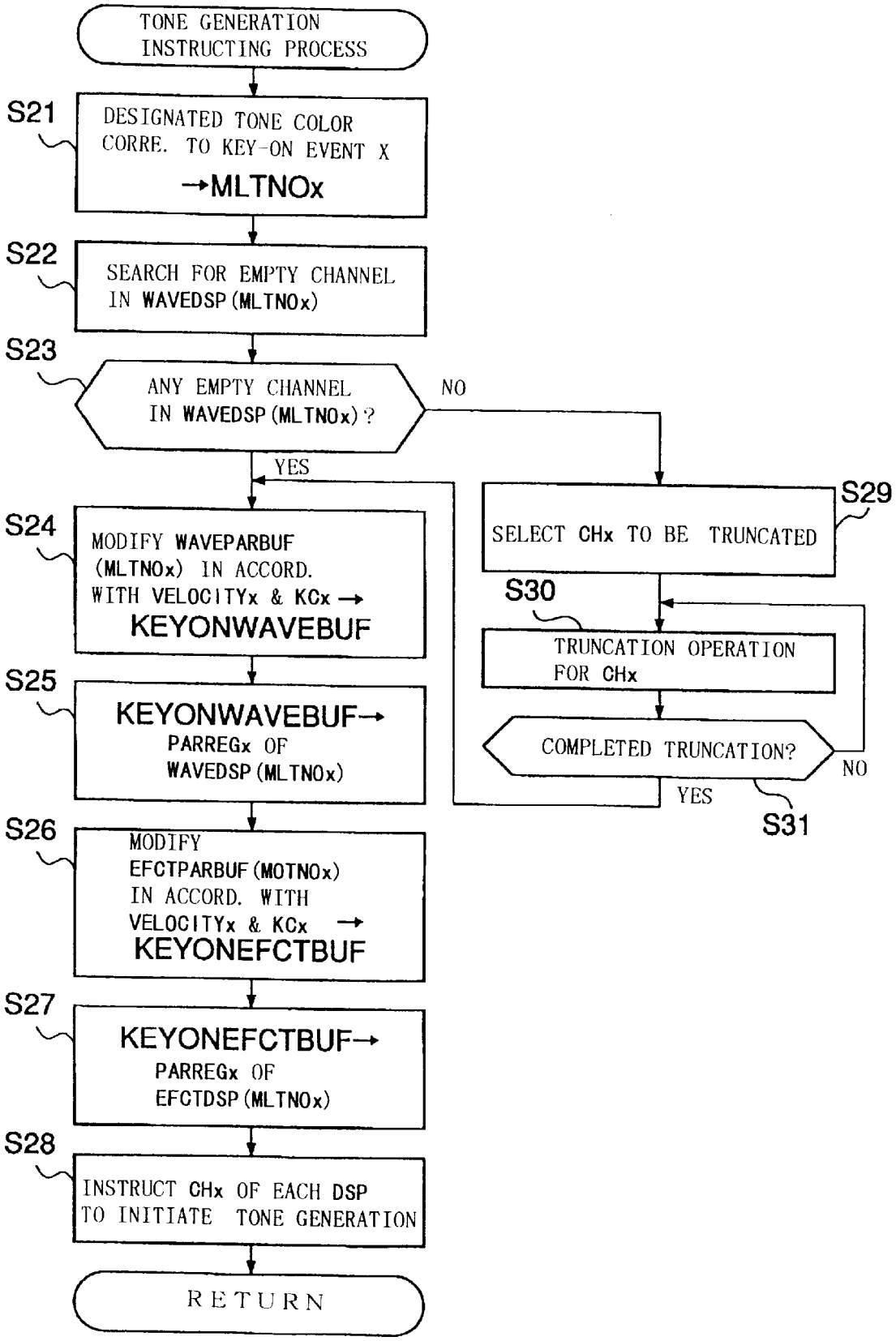
FIG. 9 is a flow chart showing a detailed step sequence of a tone-generation instructing process subroutine of FIG. 7.

FIG. 9 is a flow chart showing a detailed step sequence of the tone generation instructing process subroutine of step S6. In the illustrated example of FIG. 9, a designated tone color, i.e., processing system number, corresponding to the key-on event x is identified and stored into a predetermined area MLTNOx of the RAM 7, at first step S21. The stored content of the area MLTNOx will hereinafter be called a processing system number MLTNOx.

Then, a search is made at step S22 for an empty channel in the wave DSP (WAVEDSP(MLTNOx)) designated by the processing system number MLTNOx, and it is determined at next step S23 whether or not any empty channel has been found in the wave DSP. If answered in the affirmative at step S23, the tone-generation instructing process subroutine goes to step S24; otherwise, the process branches to step S29. At step S24, the stored content of the wave parameter buffer (WAVEPARBUF(MLTNOx)) designated by the processing system number MLTNOx is modified in accordance with the velocity (VELOCITYx) and key code (KCx) corresponding to the key-on event x, and the modified result is stored into the key-on wave buffer KEYONWAVEBUF described above in relation to FIG. 2B. At next step S25, the current stored content of the key-on wave buffer KEYONWAVEBUF is transferred to the parameter register (PARREGx) of the wave DSP (WAVEDSP(MLTNOx)) designated by the processing system number MLTNOx.

Similarly, the stored content of the effect parameter buffer (EFCTPARBUF(MLTNOx)) designated by the processing system number MLTNOx is modified in accordance with the velocity (VELOCITYx) and key code (KCx) corresponding to the key-on event x, and the modified result is stored into the key-on effect buffer KEYONEFCTBUF at step S26. At next step S27, the current stored content of the key-on effect buffer KEYONEFCTBUF is transferred to the parameter register (PARREGx) of the wave DSP (EFCTDSP (MLTNOx)) designated by the processing system number MLTNOx. Then, after an instruction to initiate tone generation is given to channel x (CHx) of each of the DSPs at step S28, the tone-generation instructing process subroutine is terminated.

At step S29, a selection is made of one of the channels which is to be truncated. The truncation may be made in various manners; for example, one of the channels where the generated tone has been attenuated to the farthest degree or whose key-on event is oldest may be designated as a truncated channel. Any desired one of the various truncation schemes may be employed in the embodiment, since the truncation scheme itself is not an essential part of the present invention. At next step S30, a truncating operation is carried out on the channel selected at step S29. The truncating operation is repeated until the desired truncation is determined as having been duly completed at step S31. With an affirmative determination at step S31, the tone generation instructing process subroutine goes to step S24.

Although the tone generation instructing process in the embodiment has been described in relation to monophonic tone generation where no intervening key-on event occurs between key-on and key-off events of a particular tone, the embodiment of the present invention can easily deal with polyphonic tone generation, where a plurality of tones are generated simultaneously, by just repeating the above-described tone-generation instructing process.

As described above, the embodiment is characterized primarily in that a different effect program is set for each of the processing systems, so as to impart a different effect to each of the processing systems by executing the different effect program. This characteristic arrangement permits impartment of any tone color, as desired by the user, depending on a selected tone color and hence achieves an increased variety of effect.

The following paragraphs describe processes executed, in the first and second effect DSPs 162 and 164 associated with the individual processing systems, for imparting ten different effects, with reference to FIGS. 10 to 21.

Figure 10A:
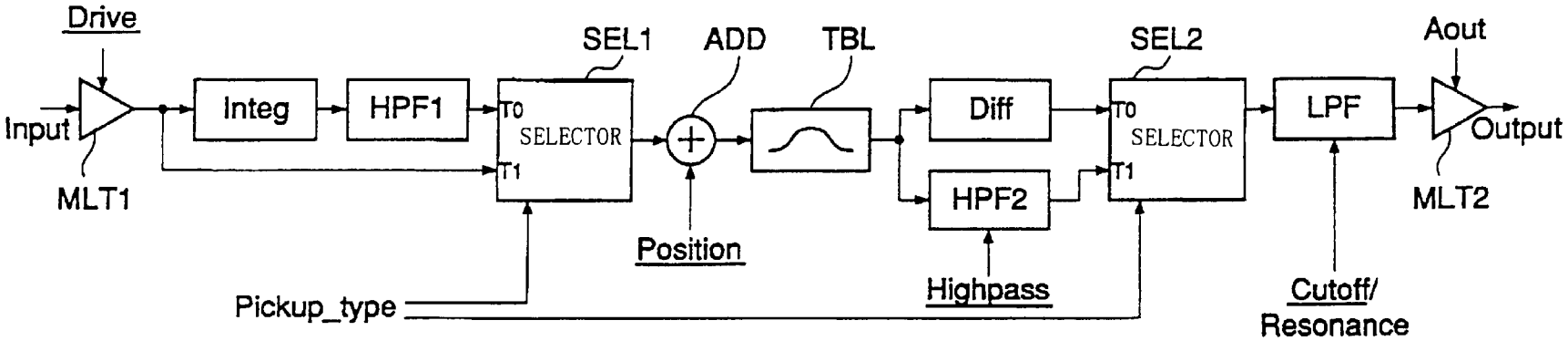
FIGS. 10A and 10B are diagrams explanatory of a process for imparting an effect specific to an electromagnetic pickup of an electric piano.
Figure 10B:
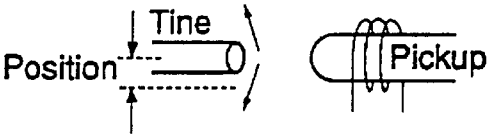

FIGS. 10A and 10B are diagrams explanatory of a process for imparting an effect (frequency characteristic) specific to an electromagnetic pickup of an electric piano. More specifically, FIG. 10A is hardware representation of an algorithm for imparting the effect, while FIG. 10B shows the electromagnetic pickup and a peripheral arrangement associated with the pickup. In the electric piano, as shown in FIG. 10B, the electromagnetic pickup is provided in opposed relation to a vibrator (Tine). The vibrator is caused to vibrate by being hit by a hammer (not shown), and the electromagnetic pickup detects the vibration of the vibrator and transduces the detected vibration into an electric signal.

The effect algorithm of FIG. 10A simulates the vibration of the vibrator that is detected by the electromagnetic pickup. In the illustrated example of FIG. 10A, an input signal Input is multiplied via a multiplier MLT1 in accordance with a value of a parameter Drive so that its amplitude is modified by the parameter Drive. The parameter Drive represents a magnitude of the vibrator's vibration, and the greater the value of the parameter Drive, the more is emphasized a tone color variation relative to a tone volume variation of the input signal Input; in other words, the parameter Drive functions to vary a distance between the electromagnetic pickup and the vibrator.

In the illustrated example of FIG. 10A, the parameter Drive is denoted with an underline, and this underline indicates that the parameter Drive is controlled in accordance with tonal information specific to the input signal Input which, in this and following figures, represents a basic tone waveform of a given channel generated by the wave DSP 161 or 163; a typical example of the tonal information is tone pitch information and the effect algorithm will be described only in relation to the case where the tonal information is tone pitch information. Specifically, a shift amount is set by which the parameter value Drive is to be shifted in a positive or negative direction in accordance with a tone pitch of the input signal Input, and the parameter Drive is controlled by adding the shift amount to the parameter value Drive. Such control is applied to any other parameters that should be controlled in accordance with a tone pitch, although any other suitable form of pitch-dependent control may be employed.

Output from the multiplier MLT1 is coupled to both an integrator Integ and an input terminal T1 of a selector SEL1. Output from the integrator Integ is fed to a high-pass filter HPF1 for removal of unnecessary low-frequency components therefrom and then sent to another input terminal T0 of the selector SEL1. Parameter Pickup_type is supplied to a select terminal of the selector SEL1. When the parameter Pickup_type is set at a value "0" or "2", the selector SEL1 outputs the signal received at the input terminal T1, but when the parameter Pickup_type is at a value "1", the selector SEL1 outputs the signal received at the input terminal T0.

Here, the parameter Pickup_type takes an integral value in the range of "0" to "2". The parameter value "0" indicates a "normal mode" in which the selector SEL1 and a rear-stage or second selector SEL2 both select the signal received at the input terminal T1 so as to provide a relatively small or shallow effect. The parameter value "1" indicates an "integrate mode" in which the input signal Input is treated as a velocity wave and integrated into a displacement wave via the integrator Integ following the multiplier MLT1 and signal processing is effected by physically modeling the operation in and around the electromagnetic pickup by selecting an output of a differentiator Diff in accordance with an output from a nonlinear table TBL which corresponds to magnetic flux density. Further, the parameter value "2" indicates a "differentiate mode" in which the first selector SEL1 selects the input terminal T1 while the second selector SEL2 selects the input terminal T0 so as to achieve the effect that high-frequency components are emphasized.

Output from the first selector SEL1 is passed to one input of an adder ADD, and a parameter Position is fed to another input of the adder ADD. The parameter Position represents positional deviation of the vibrator relative to the center of the electromagnetic pickup, and its value is controlled in accordance with a tone pitch.

Figure 11:
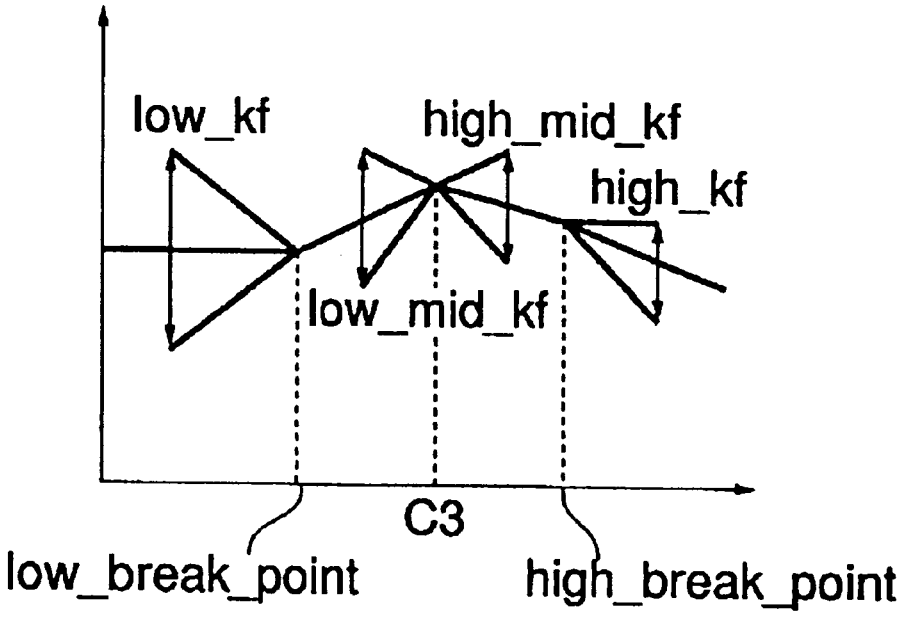
FIG. 11 is a diagram showing exemplary characteristics of a shift amount parameter for shifting a parameter Position in accordance with a tone pitch.

FIG. 11 is a diagram showing exemplary characteristics of a shift amount parameter for shifting the parameter Position in accordance with a tone pitch, where the horizontal axis represents a tone pitch and the vertical axis represents a magnitude of the shift amount parameter. Because a later-described parameter Aout is controlled similarly to the parameter Position, FIG. 11 also shows exemplary characteristics of a shift amount parameter for shifting the parameter Aout. Thus, the names of the individual parameters are noted in the figure along the vertical axis in abbreviated form.

In the illustrated example of FIG. 11, a parameter low_break_point represents a break point lower than "C3", and a parameter high_break_point represents a break point higher than "C3". Parameter Position_high_kf represents an inclination of the parameter Position above the tone pitch set by the parameter high_break_point; if the inclination is positive and points to a higher pitch, the parameter Position is set to a greater value, but if the inclination is negative and points to a lower pitch, the parameter Position is set to a smaller value. Similarly, a parameter Position_high_mid_kf represents an inclination of the parameter Position between "C3" and the tone pitch set by the parameter high_break_point, a parameter Position_low_mid_kf represents an inclination of the parameter Position between "C3" and the tone pitch set by the parameter low_break_point, and a parameter Position_low_kf represents an inclination of the parameter Position below the tone pitch set by the parameter low_break_point.

Referring back to FIG. 10, the output of the adder ADD is coupled to the nonlinear table TBL to simulate a situation where some distorting component is added to the detection signal due to an electromagnetic field produced by the electromagnetic pickup. The output signal from the adder ADD, i.e., the signal obtained by adding an offset corresponding to a value of the parameter Position to the output signal from the first selector SEL1, is imparted a distorting component by reading data from the nonlinear table TBL in accordance with the signal's amplitude level. The output from the nonlinear table TBL is sent to the differentiator Diff and to a high-pass filter HPF2. To the high-pass filter HPF2 is also supplied a parameter Highpass indicative of a cutoff frequency to eliminate low-frequency components of the output signal from the electromagnetic pickup.

The output of the differentiator Diff is coupled to the input terminal T0 of the second selector SEL2, while the output of the high-pass filter HPF2 is coupled to the input terminal T1 of the second selector SEL2. The above-mentioned parameter Pickup_type is given to the select terminal of the second selector SEL2. When the parameter Pickup_type is at the value "2", the second selector SEL2 outputs the signal received at the input terminal T0, i.e., the signal differentiated by the differentiator Diff, but when the parameter Pickup_type is at other than the value "2", the second selector SEL2 outputs the signal received at another input terminal T1, i.e., the signal having its low-frequency components eliminated therefrom by the high-pass filter HPF2.

The output signal from the second selector SEL2 is fed to a low-pass filter LPF that cuts off high-frequency components of the signal. The low-pass filter LPF is provided to give (simulate) characteristics provided by the inductance of the electromagnetic pickup; for this purpose, a parameter Cutoff indicative of a cutoff frequency and a parameter Resonance indicative of resonance characteristics of the electromagnetic pickup. The parameter Cutoff is also controlled in accordance with a tone pitch.

Output from the low-pass filter LPF is sent to another or second multiplier MLT2, where it is multiplied by a parameter Aout indicative of an output level of the electromagnetic pickup to provide an output signal Output. Here, the parameter Aout is controlled in the same manner as the above-mentioned parameter Position, although not specifically described here to avoid unnecessary duplication.

The effect algorithm of FIG. 10A is contained in the effect imparting software program (microprograms) executed by the effect DSPs 162 and 164 as described earlier and are in fact not implemented by hardware. But, the effect algorithm have been described in relation to the hardware representation, because they are deemed to be much easier to understand when explained from a hardware point of view.

Figure 12A:
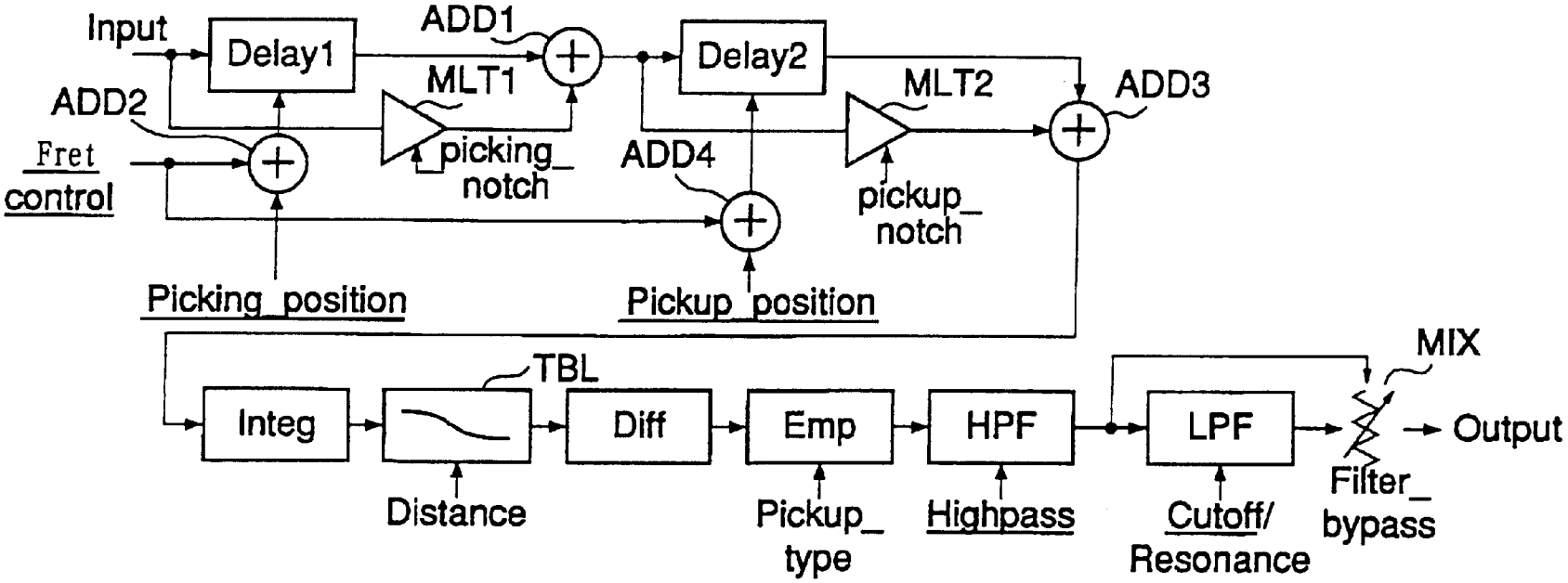
FIGS. 12A and 12B are diagrams explanatory of a process for imparting an effect specific to a relationship between a string of an electric guitar and an electromagnetic pickup.
Figure 12B:
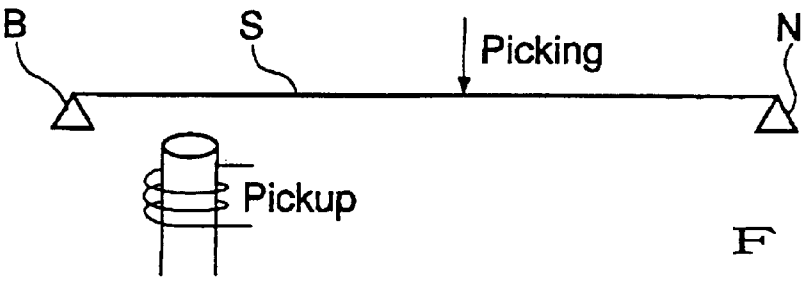

FIGS. 12A and 12B are diagrams explanatory of a process for imparting an effect (frequency characteristic) specific to a relationship between a string of an electric guitar and an electromagnetic pickup. More specifically, FIG. 12A is hardware representation of an effect algorithm for imparting the effect, while FIG. 12B shows the electromagnetic pickup and a peripheral arrangement associated with the pickup. As shown in FIG. 12B, the string S is stretched between a bridge B and a nut N, and the electromagnetic pickup is disposed at a predetermined position along the length of the string S. The electromagnetic pickup detects vibration of the string generated by a player picking the string S and transduces the detected vibration into an electric signal.

FIG. 12A shows an effect algorithm of a program for simulating phenomena occurring from the player's picking of the string S and conversion of the detected string vibration into the electric signal, i.e., tone color variation and characteristics of the electromagnetic pickup based on the positions of the player's picking and the pickup. More specifically, an input signal is converted into vibration of the string S in accordance with the positions of the player's picking and the electromagnetic pickup, and the converted vibration is detected by the pickup so that the detected vibration is output after being imparted frequency characteristics specific to the pickup.

In the illustrated example of FIG. 12A, the input signal Input is supplied to one input terminal of an adder ADD1 via a delay element Delay1 and also to another input terminal of the adder ADD1 via a multiplier MLT1. Parameter Picking_notch for imparting a tone color variation based on the player's picking position is given to the multiplier MLT1, which adjusts the amplitude of the input signal Input in accordance with a value of the parameter Picking_notch and outputs the adjusted result to the adder ADD1. The parameter Picking_notch can, by its polarity and value, variously change resonance peak characteristics of a comb filter comprised of a feedforward path passing through the delay element Delay1 and multiplier MLT1, to thereby provide diversified tone color variations. Varying the value of the parameter Picking_notch in the positive value range would constitute simulation of playing a guitar or the like while changing the string-picking position, and varying the value of the parameter Picking_notch in the negative value range would result in settings that may be unlikely in actual string vibration and hence permit creation of new tones and special effects.

As a fret position is changed, another or second adder ADD2 adds together values of a parameter Fret_control for simultaneously controlling variations of the picking position and pickup position and a parameter Picking_position, and the added result is supplied to the delay element Delay1. For example, the parameter Picking_position at a value "0" represents a position immediately adjacent to the bridge B, the parameter Picking_position at a value "127" represents a longitudinally-central position of the string S. This parameter Picking_position is also controlled in accordance with a tone pitch and thus its value is varied by a shift amount determined on the basis of the tone pitch.

Output from the first adder ADD1 is supplied to one input terminal of a third adder ADD3 via a second delay element Delay2 and also supplied to another input terminal of the third adder ADD3 via a second multiplier MLT2. The parameter Picking_notch for imparting a tone color variation based on the picking position is given to the second multiplier MLT2, which adjusts the amplitude of the input signal Input in accordance with a value of the parameter Picking_notch and outputs the adjusted result to the third adder ADD3. The parameter Picking_notch can, by its polarity and value, variously change resonance peak characteristics of a comb filter comprised of a feedforward path passing through the delay element Delay2 and multiplier MLT2, to thereby provide diversified tone color variations. Varying the value of the parameter Picking_notch in the positive value range would constitute simulation of playing the guitar or the like while changing the string-picking position, and varying the value of the parameter Picking_notch in the negative value range would result in settings unlikely in actual string vibration and hence permit creation of new tones and special effects.

Fourth adder ADD4 adds together values of the parameter Fret_control and parameter Pickup_position indicative of a pickup position, and the added result is supplied to the second delay element Delay2. For example, the parameter Pickup_position at a value "0" represents a position immediately adjacent to the bridge B, the parameter Pickup_position at a value "127" represents a longitudinally-central position of the string S. This parameter Pickup_position is also controlled in accordance with a tone pitch and thus its value is varied by a shift amount determined on the basis of the tone pitch.

Figure 13A:
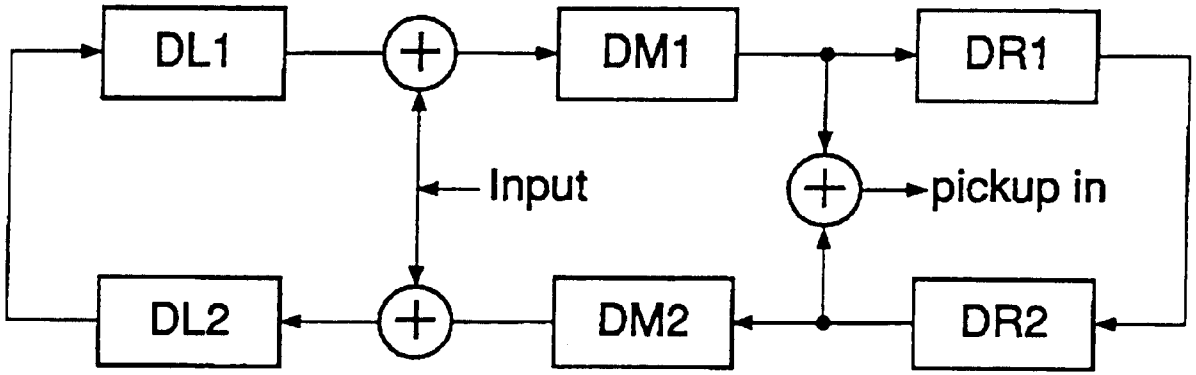
FIGS. 13A and 13B are diagrams of a string model and an equivalent circuit of the string model.
Figure 13B:
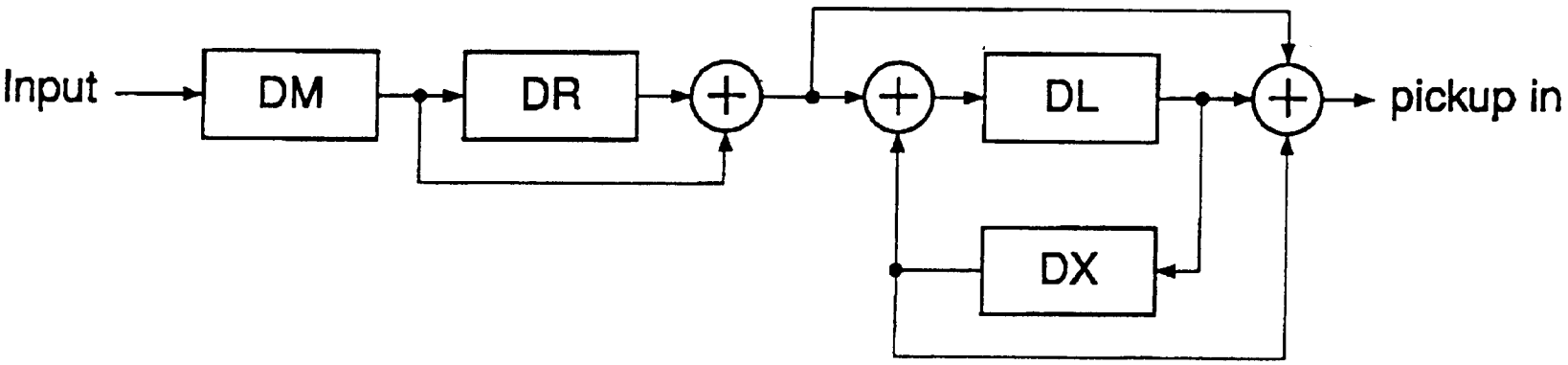

FIGS. 13A and 13B are diagrams of a string model and an equivalent conversion of the string model, which specifically illustrate theoretical reasons why vibration of the string S can be simulated appropriately via the first and second delay elements Delay1 and Delay 2 of FIG. 12. More specifically, FIG. 13A models vibration of the string S at the location of the electromagnetic pickup, i.e., string vibration conveyed to the electromagnetic pickup, and FIG. 13B shows an equivalent circuit of the model of FIG. 13A.

It is generally known that vibration generated in the string S by application of an exciting signal (vibratory force) can be expressed by the model shown in FIG. 13A. In the illustrated example of FIG. 13A, each rectangular block represents a delay element, and a delay amount in each of the delay elements is determined depending on an assumed effective length of the string as an vibrator and positions of player's picking and the electromagnetic pickup. It is assumed that the two delay elements vertically opposed to each other in the figure are set to a same delay amount. Total delay amount of the entire loop circuit, i.e., a sum of the respective delay amounts of the individual delay elements DL1, DL2, DM1, DM2, DR1 and DR2 (dl1+dl2+dm1+dm2+dr1+dr2) is determined by a pitch of a tone to be generated, and the respective delay amounts of the individual delay elements DL1, DL2, DM1, DM2, DR1 and DR2 are allocated depending on the positions of player's picking and the electromagnetic pickup.

To achieve a vibration loss characteristic and the like of the string, it is only necessary that a desired signal attenuating element, such as a filter, be inserted in the loop circuit.

Equivalent conversion of the model of FIG. 13A provides the model of FIG. 13B, where the delay amount dm of the delay element DM corresponds to the sum between the delay amount dm1 and dm2 of the delay elements DM1 and DM2 of FIG. 13A and similarly the delay amounts dr, dl and dx of the delay elements DR, DL and DX correspond to those of FIG. 13A as follows:

$$dr=dr1+dr2$$

$$dl=dl1+dl2$$

$$dx=dt(=dr+dl+dm)-dl=dr+dm$$

By further equivalent conversion (or simplification) of the model of FIG. 13B, there can be provided the circuitry of FIG. 12A that is comprised of the first and second delay elements Delay1 and Delay2 and first and third adders ADD1 and ADD3. Namely, the circuitry of FIG. 12A can simulate vibration generated in the string S. Of course, the arrangement of FIG. 13A or 13B may be used directly in the string model of FIG. 12A.

Referring back to FIG. 12, the output of the third adder ADD3 is coupled to an integrator Integ, and the output signal from the integrator Integ is fed to a nonlinear table TBL to simulate a situation where some distorting component is added to the detection signal due to an electromagnetic field produced by the pickup. Parameter Distance indicative of a distance between the electromagnetic pickup and the string S is also fed to the nonlinear table TBL. Value of the parameter Distance is added to the integrated output from the integrator Integ, and data is read out from the nonlinear table TBL on the basis of the added result, so as to output the detection signal having a predetermined distorting component imparted thereto. The parameter Distance functions in such a way that a smaller value of the parameter would produce a greater output level and emphasize distortion of the electromagnetic pickup.

The output data from the nonlinear table TBL is subjected to differentiation by a differentiator Diff and then supplied to an emphasized Emp (similar in function to an equalizer) which operates to emphasize a predetermined frequency component. Parameter Pickup_type, indicative of a particular type of the electromagnetic pickup, is supplied to the emphasized Emp, which emphasizes a predetermined frequency component of the input signal in accordance with a value of the parameter Pickup_type, i.e., a particular pickup type. The parameter Pickup_type takes one of integral values "0" and "1"; when the parameter Pickup_type is at the value "0", a frequency component of the input signal is emphasized to provide a well-spreading high-pitch tone specific to a single-coil pickup, while the parameter Pickup_type is at the value "1", a frequency component of the input signal is emphasized to provide a mellow tone specific to a humbacking pickup.

The output of the emphasized Emp is coupled to a high-pass filter HPF, to which is supplied a parameter Highpass indicative of a cutoff frequency for eliminating low-frequency components from the pickup output. This parameter Highpass is controlled in accordance with a tone pitch. The output signal from the high-pass filter HPF is supplied directly to one input terminal of a mixer MIX capable of varying its mixing ratio and also supplied via a low-pass filter LPF to another input terminal of the mixer MIX. To the low-pass filter LPF are also fed a parameter Cutoff indicative of a cutoff frequency of a filter for achieving characteristics provided by the inductance of the electromagnetic pickup and a parameter Resonance indicative of resonance characteristics of the electromagnetic pickup. Thus, the low-pass filter LPF supplies the other input terminal of the mixer MIX with a signal having its high-frequency components eliminated therefrom in accordance with these parameters Cutoff and Resonance.

The mixer MIX is also supplied with a parameter Filter_bypass indicative of a bypassing proportion of the characteristics of the electromagnetic pickup, i.e., a mixing ratio between the signal having its high-frequency components eliminated therefrom by the low-pass filter LPF and a signal bypassing the low-pass filter LPF. In accordance with a value of the parameter Filter_bypass, the mixer MIX mixes the output signal from the low-pass filter LPF and the signal directly output from the high-pass filter HPF, to provide the mixed result as an output signal Output.

Figure 14:
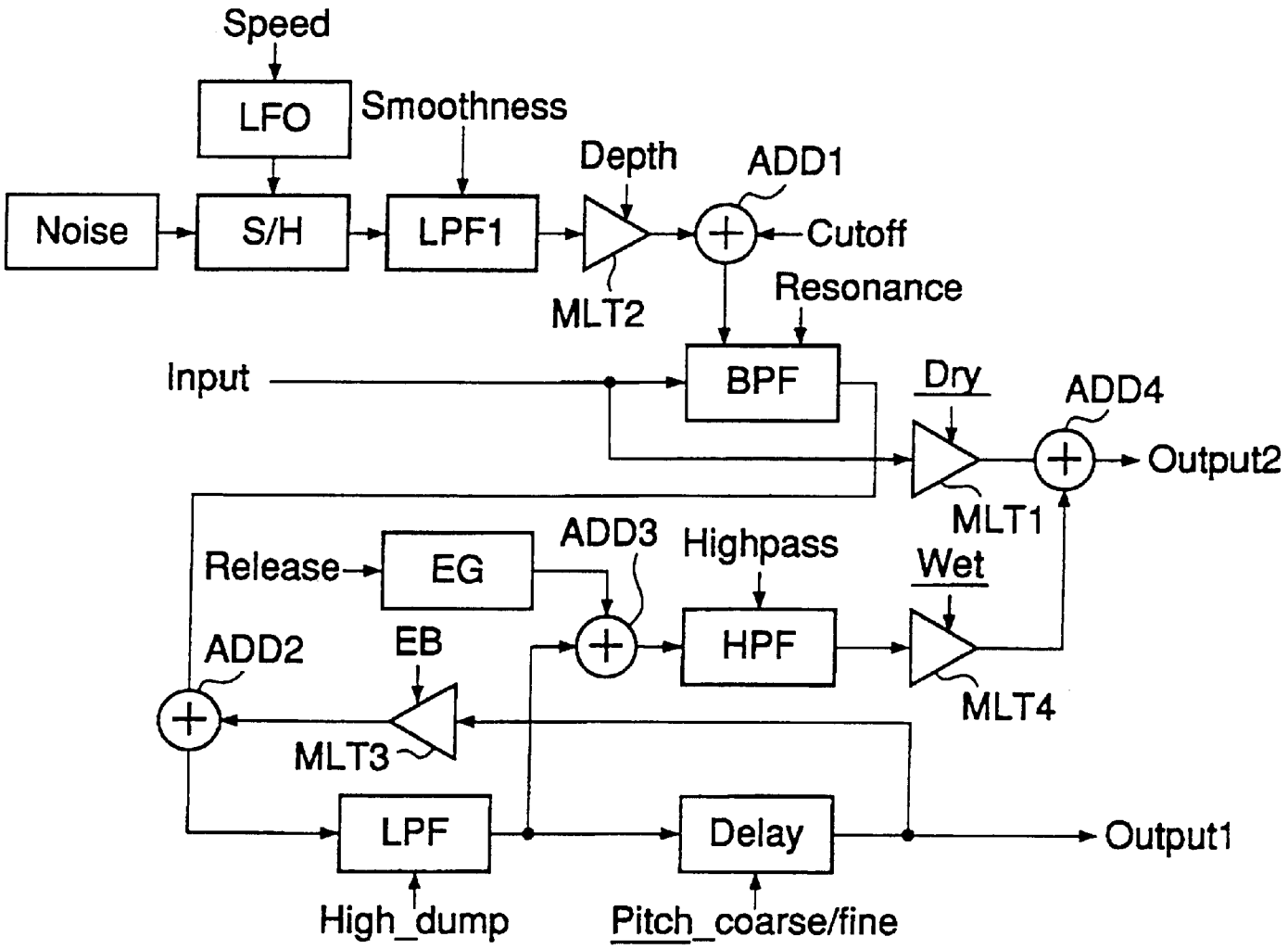
FIG. 14 is a block diagram explanatory of a process for imparting an effect to change an input signal into a water sound.

FIG. 14 is a block diagram explanatory of a process for imparting an effect to change an input signal into a water sound and shows effect algorithm therefor from a hardware point of view. According to the effect algorithm, filter modulation is applied to the input signal, using a sample and hold LFO (Low Frequency Oscillator), to produce a feeling of a water flow, and a feeing of pitch based on resonating string characteristics corresponding to a tone pitch. In the illustrated example of FIG. 14, an input signal Input is supplied to both a band-pass filter BPF and a multiplier MLT1, and a parameter Resonance indicative of resonance of the filter BPF and an output from an adder ADD1 are fed to the filter BPF.

Parameter Cutoff, indicative of a center frequency of the filter modulation, is fed to one input terminal of the adder ADD1, and an output from a second multiplier MLT2 is passed to another input terminal of the adder ADD1. Noise signal generated by a noise generator Noise is sampled and held by a sample and hold circuit S/H in response to a signal generated by an ultra-low-frequency oscillator LFO and then sent to a low-pass filter LPE for removal of high-frequency components therefrom. The second multiplier MLT2 multiplies the output signal from the low-pass filter LPF by a parameter Depth indicative of a depth of the filter modulation. In this example, a sample and hold LFO is constituted by various component elements including the above-mentioned noise generator Noise to the second multiplier MLT2.

The ultra-low-frequency oscillator LFO is supplied with a parameter Speed indicative of an operating speed of the sample and hold LFO. Greater value of the parameter Speed, i.e., faster operating speed of the sample and hold LFO, will make the water flow sound more rapid. Further, the low-pass filter LPF is supplied with a parameter Smoothness indicative of operational smoothness of the sample and hold LFO. Depending on the setting of the parameter Smoothness, the water flow will sound as if the viscosity of the water were changing.

The output from the band-pass filter BPF is passed to one input terminal of a second adder ADD2 and an output from a third multiplier MLT3 is fed to another input terminal of the second adder ADD2. The added result of the second adder ADD2 is sent to a second low-pass filter LPF2. The second low-pass filter LPF2 is supplied with a parameter High_dump indicative of a high-frequency attenuation amount within the resonating string. Specifically, the parameter High_dump corresponds to the material of the string. The output from the second low-pass filter LPF2 is supplied to both a delay element Delay and a third adder ADD3. The delay element Delay is supplied with a parameter Pitch_coarse for setting a pitch of the resonating string by the semitone, as well as a parameter Pitch_fine for finely adjusting the pitch of the resonating string by the cent.

The output from the delay element Delay is supplied to the outside as an output signal Output1 and also to the third multiplier MLT3. The third multiplier MLT3 is also supplied with a parameter FB indicative of intensity of the resonance of the resonating string, so that the amplitude of the output signal from the delay element Delay is modified by the parameter FB, namely, a feedback amount is adjusted. Here, the greater the value of the parameter FB, the clearer becomes a feeling of pitch; however, too great a value of the parameter FB will result in a loss of the feeling of water flow.

Output from an envelope generator EG is passed to another input terminal of the third adder ADD3. The envelope generator EG is supplied with a parameter Release indicative of an attenuating time of the output signal after a note-off instruction, so that the generator EG generates an envelope signal on the basis of the parameter Release. The output of the third adder ADD3 is coupled to a high-pass filter HPF, which is supplied with a parameter Highpass indicative of a cutoff frequency of the high-pass filter HPF to be applied to a water sound output. The high-pass filter HPF supplies a fourth multiplier MLT4 with a signal from which has been eliminated frequency components lower than the cutoff frequency represented by the parameter Highpass.

The fourth multiplier MLT4 is also supplied with a parameter Wet indicative of a water sound output level, so that the water sound output level is adjusted in accordance with a value of the parameter Wet and the thus-adjusted result is passed from the multiplier MLT4 to one input terminal of a fourth adder ADD4. The output from the first multiplier MLT1 is sent to another input terminal of the fourth adder ADD4. The first multiplier MLT1 is supplied with a parameter Dry indicative of an output level of an input signal Input, so that the output level of the signal Input is adjusted in accordance with a value of the parameter Dry and the thus-adjusted result is passed to the adder ADD4. The fourth adder ADD4 adds together the input signal Input and the water sound output signal from the fourth multiplier MLT4 and provides the added result to the outside as an output signal Output2.

Figure 15:
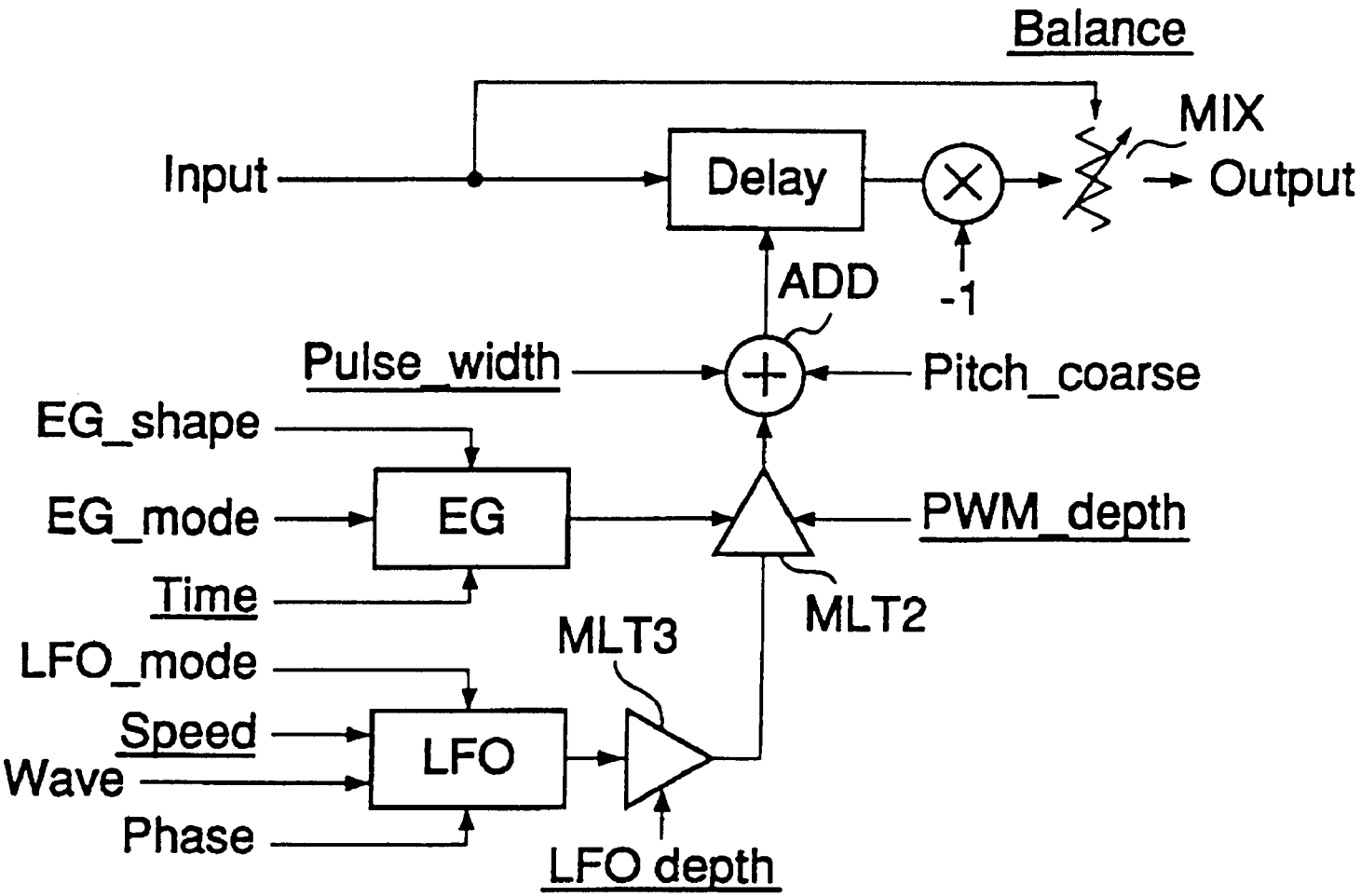
FIG. 15 is a block diagram explanatory of a process for imparting an effect analogous to a PWM effect of an analog synthesizer.

FIG. 15 is a block diagram explanatory of a process for imparting en effect analogous to a PWM (Pulse Width Modulation) effect of an analog synthesizer, which specifically illustrates an effect algorithm therefor from a hardware point of view. The effect algorithm is built on the basis of the following operating principle.

In view of the principle that a pulse waveform is provide by evaluating a difference between a phase-shifted sawtooth waveform and an original waveform corresponding thereto, a difference is evaluated between an input waveform and the input waveform having been passed through a delay element and the readout location (phase) of the delay element is modulated by an ultra-low-frequency oscillator, envelope generator and the like, so that a PWM waveform is produced from, for example, an original sawtooth waveform. Such an arrangement ultimately functions as a comb filter and thus operates on any input to weaken particular overtones thereof. Where the delay element has just half the period of the input signal, even-numbered-order overtones are cancelled, leaving only odd-numbered-order overtones. With such comb-like frequency characteristics, it is possible to simulate frequency characteristics as achieved through PWM operations by a VCO (Voltage Controlled Oscillator) of an analog synthesizer. As a consequence, a feeling of chorus just as achieved by the PWM can be imparted to any waveform input.

In the illustrated example of FIG. 15, an input signal Input is supplied to one input terminal of a mixer MIX variable in its mixing ratio, via a delay element Delay whose delay amount is determined by later-described parameters and a multiplier MLT1 that inverts the input signal (i.e., output signal from the delay element Delay) in response to an input value "1". The input signal Input is also supplied directly to another input terminal of the mixer MIX. The mixer MIX is also supplied with a parameter Balance indicative of a ratio of mixing between the input signal Input and the delayed signal. When the parameter Balance is at a value "0", the mixer MIX provides the input signal Input alone as an output signal Output. With the parameter Balance at a value "32", the mixer MIX provides a difference between the input signal Input and the delayed signal as an output signal Output with a normal PWM effect, and with the parameter Balance at a value "−32", the mixer MIX provides a sum between the input signal Input and the delayed signal as an output signal Output with a chorus effect imparted thereto.

The delay element Delay is also supplied with an output from an adder ADD having three input terminals, so that the element Delay delays the input signal Input by a delay amount determined in accordance with an output value of the adder ADD. To the three input terminals of the adder ADD are fed a parameter Pulse_width for setting a pulse width, a parameter Pitch_coarse for setting a delay length by the semitone and an output from a second multiplier MLT2 having three input terminals. The parameter Pulse_width may be set to various values such that its value "64", for example, results in a 50% pulse width. The parameter Pitch_coarse may be set to various values such that the parameter Pitch_coarse at a value "0", for example, results in a delay length corresponding to C3 (=261.63 Hz), although it is normally maintained at a fundamental pitch of the input signal Input. To the three input terminals of the second multiplier MLT2 are supplied an output from an envelope generator EG, a parameter PWM_depth indicative of a depth of pulse width modulation and the output signal of the ultra-low-frequency oscillator LFO adjusted in amplitude via a third multiplier MLT3.

The envelope generator EG is supplied with a parameter EG_mode indicative of its operating mode, a parameter EG_shape indicative of a shape (depth) of an envelope and a parameter Time indicative of an arrival time of the envelope. The parameter EG_mode takes an integral value in the range of "0" to "2". That is: with the parameter EG_mode at the value "0", the envelope generator EG generates an envelope of a decay portion of a tone waveform; with the parameter EG_mode at the value "1", the envelope generator EG generates an envelope of an attack portion; and with the parameter EG_mode at the value "2", the envelope generator EG generates a fade-in envelope. Further, with the parameter EG_shape at a value "0", no envelope is generated (a maximum value is maintained); with the parameter EG_shape at a value "32", a 50% envelope depth results; and with the parameter EG_shape at a value "64", a 100% envelope depth results. However, when a fade-in is instructed, the delay element Delay becomes operative with the parameter EG_shape at "32" or over. The parameter Time is also controlled in accordance with a tone pitch, and thus the envelope arrival time is varied depending on the tone pitch.

The ultra-low-frequency oscillator LFO is supplied with a parameter LFO_mode indicative of its operating mode, a parameter Speed indicative of its frequency, a parameter Wave indicative of a type of its output waveform and a parameter Phase indicative of a phase of the oscillator LFO that is reset upon receipt of a note-on instruction. The ultra-low-frequency oscillator LFO generates an output waveform corresponding to these parameters. Here, the parameter LFO_mode takes an integral value in the range of "0" to "2. That is: the parameter LFO_mode at the value "0" represents a mode where the ultra-low-frequency oscillator LFO is shared for every note; the parameter LFO_mode at the value "1" represents a mode where the ultra-low-frequency oscillator LFO is used on a note-by-note basis and reset in response to each note-on instruction; and the parameter LFO_mode at the value "2" represents a mode where the ultra-low-frequency oscillator LFO is used on a note-by-note basis and the oscillator's phase at the time of a note-on instruction varies randomly. The parameter Wave takes, for example, an integral value "0" or "1"; the parameter Wave at the value "0" represents a mode where a triangular waveform is output from the ultra-low-frequency oscillator LFO, and the parameter Wave at the value "1" represents a mode where a sine waveform is output from the ultra-low-frequency oscillator LFO. Further, the parameter Phase is set to various values that the ultra-low-frequency oscillator LFO represents, for example, any one of 0°, 90°, 180° and 270° phases.

The third multiplier MLT3 is also supplied with a parameter Depth indicative of a depth of pulse width modulation in the ultra-low-frequency oscillator LFO, so that the output signal from the ultra-low-frequency oscillator LFO is adjusted in amplitude in accordance with the parameter Depth and then passed to the second multiplier MLT2. For example, when the parameter Depth is set at a value "0", the output from the ultra-low-frequency oscillator LFO is made invalid and the output from the envelope generator EG alone is made valid. With the parameter Depth at a value "32", the output from the ultra-low-frequency oscillator LFO swings from a zero amplitude up to an envelope amplitude generated by the envelope generator EG. With the parameter Depth at a value "64", the ultra-low-frequency oscillator LFO generates a positive or negative output signal whose absolute amplitude value swings up to an envelope amplitude generated by the envelope generator EG.

Figure 16:
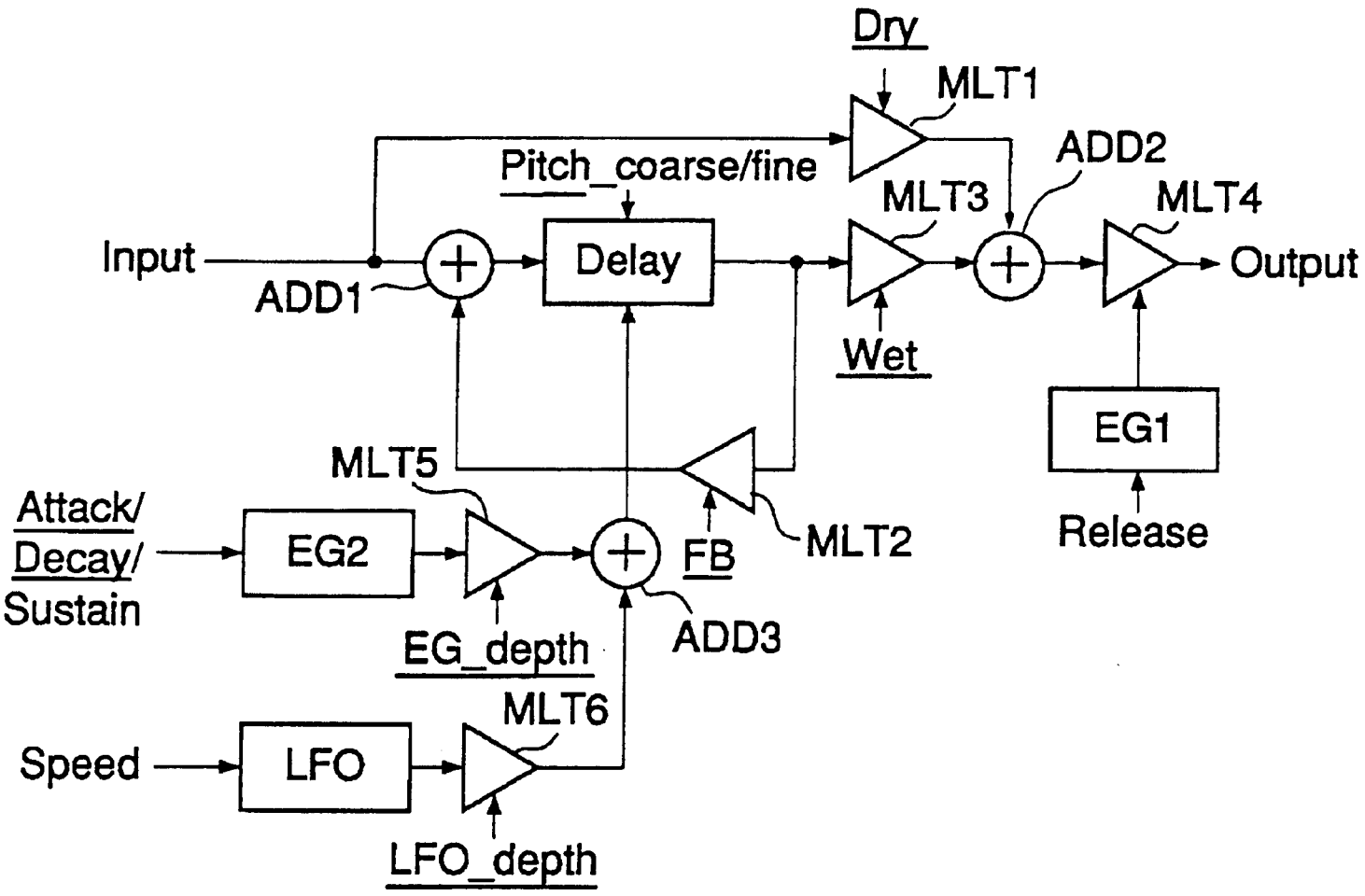
FIG. 16 is a block diagram explanatory of a process for imparting an effect generated by a flanger.

FIG. 16 is a block diagram explanatory of a process for imparting an effect generated by a flanger that is an effector to produce a sound similar to an ascending/descending sound of a jet plane, which specifically illustrates an effect algorithm therefor from a hardware point of view. The effect algorithm is based on the following operating principle.

Dips (valleys) are produced in a plurality of frequencies by mixing an input signal and a signal obtained by delaying the input signal through a delay element, and a plurality of peaks are produced by feeding back the output from the delay element. Delay length of the delay element is modulated by an envelope generator and/or ultra-low-frequency oscillator LFO so that it functions as a special filter capable of varying the frequencies of the dips and peaks. Special effect is achieved by precisely associating the delay length with a pitch frequency.

In the illustrated example of FIG. 16, an input signal Input is supplied to one input terminal of an adder ADD1 as well as to one input terminal of a multiplier MLT1. To another input of the multiplier MLT1 is supplied a parameter Dry indicative of an output level of the input signal Input, so that the input signal Input is adjusted in amplitude in accordance with a value of the parameter Dry and then passed to one input terminal of a second adder ADD2. Second multiplier MLT2 adjusts the amplitude of an output signal from a delay element Delay, whose delay amount is determined on the basis of later-described various parameters, in accordance with a value of a parameter Feedback indicative of a feedback amount (feedback amount of a flanger). The resultant amplitude-adjusted signal is then fed back to another input terminal of the first adder ADD1. The greater the value of the parameter Feedback, the more are emphasized frequency peaks of the input signal Input.

The output of the first adder ADD1 is coupled to the delay element Delay, and the output signal from the delay element Delay is fed to both the second multiplier MLT2 and one input terminal of a third multiplier MLT3. To another input terminal of the third multiplier MLT3 is supplied a parameter Wet indicative of an output level of a signal with a flanger effect imparted thereto. Thus, the third multiplier MLT3 adjusts the amplitude of the flanger-effect-imparted signal in accordance with a value of the parameter Wet and sends the thus-adjusted signal to another input terminal of a second adder ADD2.

The output of the second adder ADD2 is coupled to one input terminal of a fourth multiplier MLT4. To another input terminal of the fourth multiplier MLT4 is coupled an output of an envelope generator EG1 which outputs an envelope having its attenuating time controlled in accordance with a parameter Release indicative of an attenuating time of an output signal after a note-off instruction. The fourth multiplier MLT4 adjusts the amplitude of the output signal from the second adder ADD2 and provides the resultant amplitude-adjusted signal to the outside as an output signal Output.

The delay element Delay is supplied with an output from a third adder ADD3 which adds together an envelope output from an envelope generator EG2 and an output signal from an ultra-low-frequency oscillator LFO. The delay element Delay delays the output signal from the first adder ADD1 by an amount corresponding to the added result of the third adder ADD3. The envelope generator EG2 is supplied with a parameter Attack indicative of an attack time of an envelope, a parameter Decay indicative of a decay time of the envelope and a parameter Sustain indicative of a stabilized level of the envelope, so that it generates an envelope on the basis of these parameters and passes the resultant generated envelope to a fifth multiplier MLT5. The fifth multiplier MLT5 adjusts the amplitude of the envelope from the envelope generator EG2 in accordance with a value of a parameter EG_depth for adjusting the output level of the multiplier MLT5. Here, the parameters Attack and Decay are both controlled in accordance with a tone pitch.

The ultra-low-frequency oscillator LFO is supplied with a parameter Speed indicative of a frequency of its output signal and generates a signal of a frequency corresponding to a value of the parameter Speed, to feed the generated signal to a sixth multiplier MLT6. The sixth multiplier MLT6 is supplied with a parameter LFO_depth to adjust the amplitude of the output signal from the ultra-low-frequency oscillator LFO in accordance with a value of the parameter LFO_depth and passes the resultant amplitude-adjusted signal to the third adder ADD3.

Figure 17:
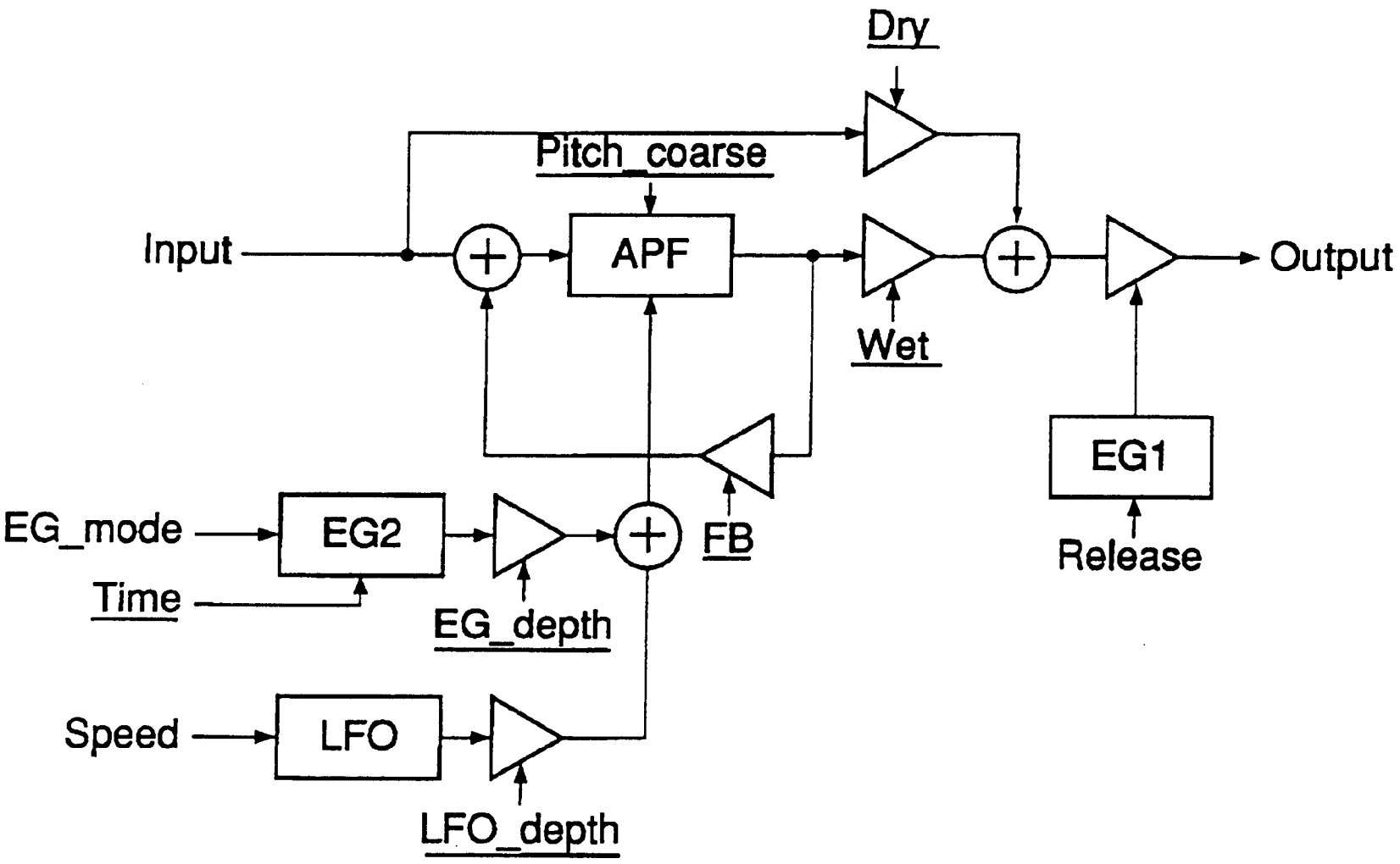
FIG. 17 is a block diagram explanatory of a process for imparting an effect generated by a phaser.

FIG. 17 is a block diagram explanatory of a process for imparting an effect generated by a phaser that is an effector to give a feeling of rotation, expansiveness and depth, which specifically illustrates an effect algorithm therefor from a hardware point of view. The effect algorithm is based on the following operating principle.

Dips (valleys) are produced in a plurality of frequencies by mixing an input signal and a signal obtained by delaying the phase of the input signal through an all-pass filter, and a plurality of peaks are produced by feeding back the output from the all-pass filter. The all-pass coefficient is modulated by an envelope generator and/or ultra-low-frequency oscillator LFO so that the all-pass filter functions as a special filter capable of varying the frequencies of the dips and peaks. Special effect is achieved by precisely associating the phase variation with a pitch frequency.

As seen from FIG. 17, this process is generally similar to the effect imparting process of FIG. 16, but different therefrom in that an all-pass filter APF is employed in place of the delay element Delay and in the types of parameters to be supplied to an envelope generator EG2. Only features different from those of the process of FIG. 16 are stated below.

The all-pass filter APF is used to impart a phase delay to an input signal Input. Envelope generator EG2 is supplied with a parameter EG_mode indicative of an operating mode of the generator EG2 and a parameter Time indicative of an arrival time of an envelope. The parameter EG_mode takes one of integral values "0" and "1"; with the parameter EG_mode at the value "0", the envelope generator EG2 is allowed to generate an envelope of a decay type, and with the parameter EG_mode at the value "1", the envelope generator EG2 is allowed to generate an envelope of an attack or rising type.

Figure 18:
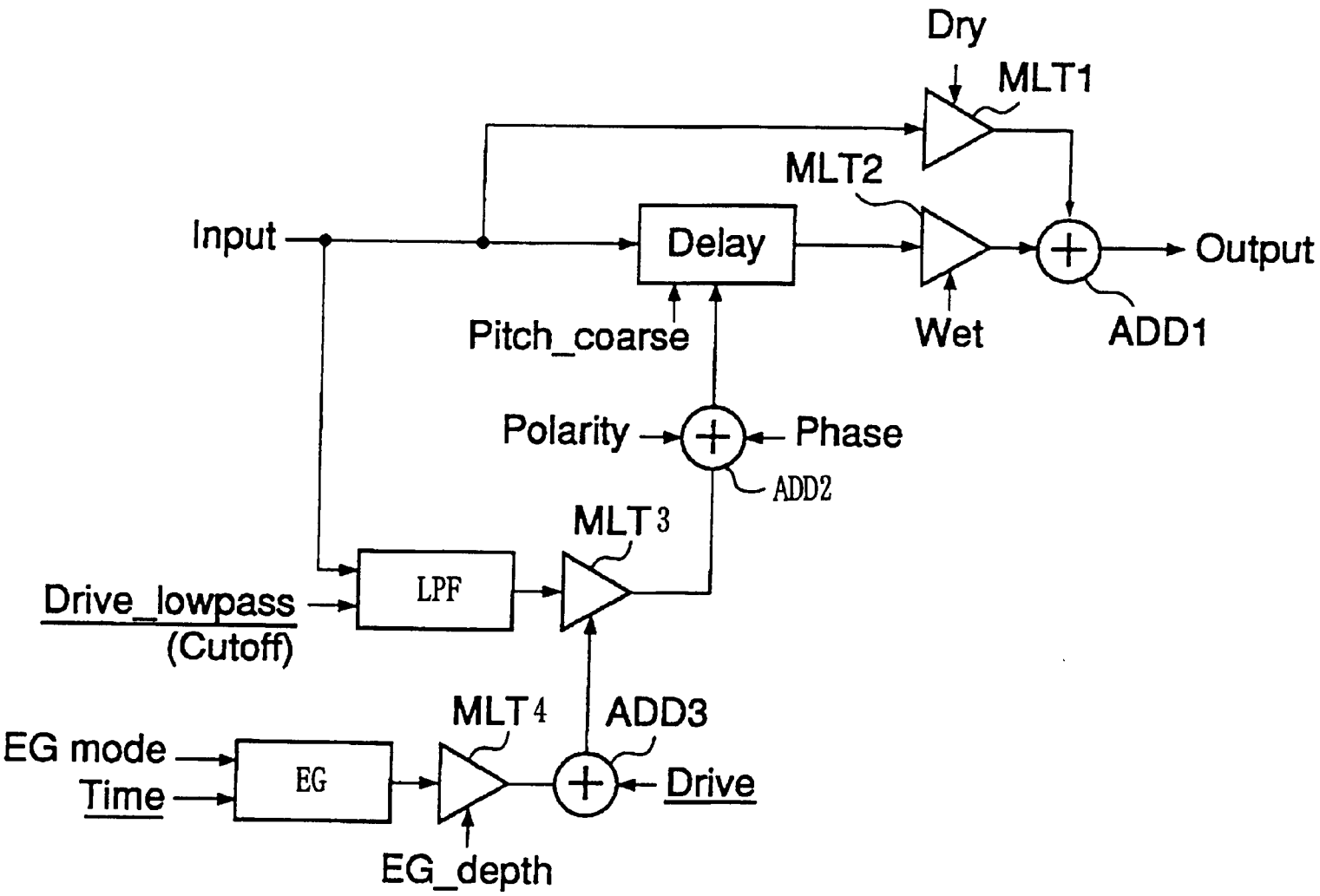
FIG. 18 is a block diagram explanatory of a process for imparting an effect to give overtone or harmonic components to an input signal.

FIG. 18 is a block diagram explanatory of a process for imparting an effect to give overtone or harmonic components to an input signal, which specifically illustrates an effect algorithm therefor from a hardware point of view. Such an effect can be obtained by supplying the input signal to a delay element and modulating a readout position (phase) of the delay element to thereby give torsion to a waveform.

In the illustrated example of FIG. 18, an input signal Input is supplied to one input terminal of a multiplier MLT1 and then passed to one input terminal of an adder ADD1. Simultaneously, the input signal Input is supplied to another input terminal of the adder ADD1 by way of a delay element Delay and a second multiplier MLT2, as well as to a low-pass filter LPF for eliminating high-frequency components from the input signal Input. The first adder ADD1 adds together the two signals from the first and second multipliers MLT1 and MLT2 and provides the added result to the outside as an output signal Output.

The first multiplier MLT1 is supplied with a parameter Dry indicative of an output level of the input signal Input, so that the input signal Input is adjusted in amplitude by the multiplier MLT1 in accordance with a value of the parameter Dry. The second multiplier MLT2 is supplied with a parameter Wet indicative of an output level of a modulated signal with a flanger effect imparted thereto, so that the multiplier MLT2 adjusts the amplitude of the modulated signal in accordance with a value of the parameter Wet.

The delay element Delay is also supplied with a parameter Pitch_coarse for setting a delay length by the semitone and an output from a second adder ADD2 having three input terminals. The parameter Pitch_coarse may be set to various values, and the parameter Pitch_coarse at a value "0", for example, results in a delay length corresponding to C3 (=261.63 Hz); if a deeper modulation is desired, however, the parameter Pitch_coarse is set to a smaller value. For example, the parameter Pitch_coarse set at a value "−12" will make the delay length twice as great as that provided at a fundamental pitch, and the parameter Pitch_coarse at a value "−24" will make the delay length four times as great as that provided at the fundamental pitch.

To the three input terminals are supplied a parameter Phase for setting a readout position (phase) in the delay element Delay functioning as a main element for the modulation, a parameter Polarity indicative of a direction of the modulation and the output from the second multiplier MLT2. Varying the value of the parameter Phase will change a phase relationship between the input to the delay element Delay and the readout position (phase) in the delay element Delay, to thereby vary the tone color of the input signal Input. The parameter Polarity takes one of integral values "0" and "1"; with the parameter Polarity at the value "0", the delay element Delay is controlled so that the delay amount increases as the input signal increases, and with the parameter Polarity at the value "1", the delay element Delay is controlled so that the delay amount decreases as the input signal increases.

To a third multiplier MLT3 are supplied the output from the low-pass filter LPF and an output from a third adder ADD3. The low-pass filter LPF is supplied with a parameter Drive_lowpass indicative of a cutoff frequency of the filter to eliminate high-frequency components of the input signal Input; the parameter Drive_lowpass is also controlled in accordance with a tone pitch. In accordance with the thus-set parameter Drive_lowpass, the low-pass filter LPF supplies the third multiplier MLT3 with the input signal Input having its high-frequency components eliminated therefrom. To the third adder ADD3 are supplied with a parameter Drive indicative of a modulation depth of an envelope output from an envelope generator EG that is amplitude-adjusted via a fourth multiplier MLT4; the parameter Drive is also controlled in accordance with a tone pitch.

The envelope generator EG2 is supplied with a parameter EG_mode indicative of an operating mode of the generator EG2 and a parameter Time indicative of an arrival time of an envelope. The parameter EG_mode takes one of integral values "0" and "1"; with the parameter EG_mode at the value "0", the envelope generator EG is allowed to generate an envelope of a decay type, and with the parameter EG_mode at the value "1", the envelope generator EG is allowed to generate an envelope of an attack or rising type. The envelope generated by the envelope generator EG in accordance with these parameters is fed to the third multiplier MLT3.

The fourth multiplier MLT4 is supplied with a parameter EG_depth for adjusting the output level of the multiplier MLT4, in accordance with which the multiplier MLT4 adjusts the amplitude of the envelope from the envelope generator EG and passes the resultant amplitude-adjusted envelope to the third adder ADD3. The third adder3 adds together values of the resultant amplitude-adjusted envelope and the parameter Drive and passes the added result to the third multiplier MLT3. The third multiplier MLT3 adjusts the amplitude of the input signal Input, sent from the low-pass filter LPF after having its high-frequency components eliminated therefrom, in accordance with the output value from the third adder ADD3, and feeds the resultant amplitude-adjusted signal to the second adder ADD2.

Figure 19:
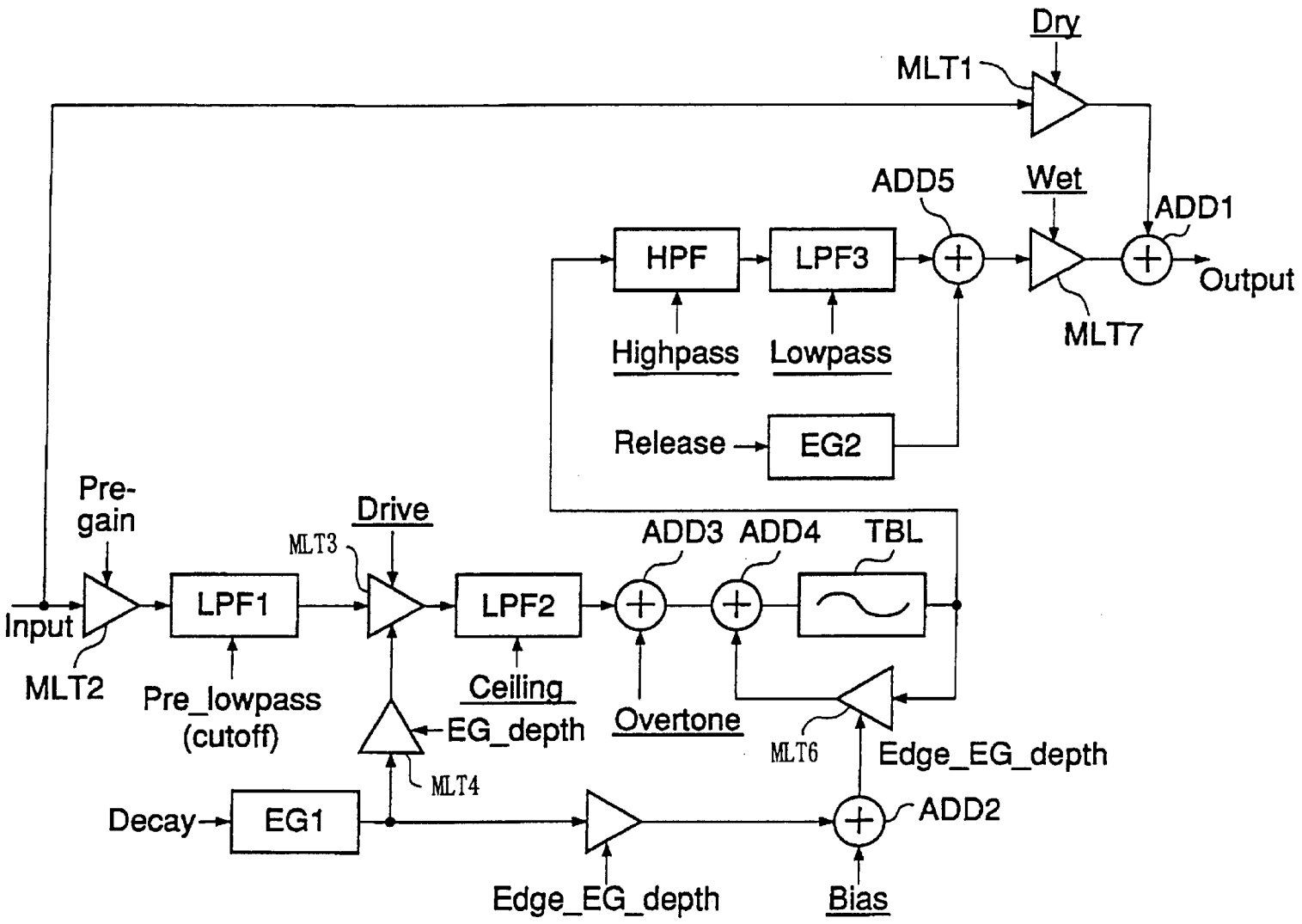
FIG. 19 is a block diagram explanatory of a process for imparting an effect via a non-carrier FM operator using an input signal as a modulator.

FIG. 19 is a block diagram explanatory of a process for imparting an effect via a non-carrier (zero-carrier-frequency) FM operator using an input signal as a modulator, which specifically illustrates an effect algorithm therefor from a hardware point of view. The effect algorithm is based on the following operating principle.

Namely, a modulator waveform is provided by processing an input signal, in accordance with which a sine waveform is read out. Deeper modulation will cause a greater phase variation and thus result in a tone with its high-frequency components emphasized, while shallower modulation will cause a smaller phase variation and thus result in a tone with its low-frequency components emphasized. Further, the waveform to be read out can be varied, via feedback frequency modulation, from the sine waveform to a saw-tooth waveform having a great number of overtones; thus, it is possible to provide a variety of sounds ranging from an FM sound to a sound as produced by an analog synthesizer.

In the illustrated example of FIG. 19, an input signal Input is supplied to a first multiplier (amplifier) MLT1 as well as to a second multiplier MLT2. The first multiplier MLT1 is supplied with a parameter Dry indicative of an output level of the input signal Input, so that the multiplier MLT1 adjusts the amplitude of the signal Input in accordance with a value of the parameter Dry and passes the resultant amplitude-adjusted signal to one input terminal of an adder ADD1. The second multiplier MLT2 is supplied with a parameter Pre_gain indicative of a gain with which to amplify the input signal Input to be used for modulation, so that the multiplier MLT2 amplifies the amplitude of the signal Input in accordance with a value of the parameter Pre_gain and passes the resultant amplitude-adjusted signal to a low-pass filter LPF1.

Parameter Pre_lowpass, indicative of a cutoff frequency to eliminate high-frequency components from a modulated signal, is given to the low-pass filter LPF1, so that the filter LPF1 filters out high-frequency components of the output signal from the second multiplier MLT2 and then sends the signal to one of three input terminals of a third multiplier MLT3. To the third multiplier MLT3 are supplied a parameter Drive indicative of a modulation depth and an output from a fourth multiplier MLT4. The parameter Drive is also controlled in accordance with a tone pitch.

The fourth multiplier MLT4 is supplied with a parameter EG_depth for adjusting the output level of the multiplier MLT4, in accordance with which the multiplier MLT4 adjusts the amplitude of an envelope from an envelope generator EG1 and passes the resultant amplitude-adjusted envelope to the third multiplier MLT3. The output from the envelope generator EG1 is sent to the fourth multiplier MLT4 and a fifth multiplier MLT5. The fifth multiplier MLT5 is supplied with a parameter Edge_EG_depth indicative of a modulation depth with which to modulate an FM feedback amount using the envelope output from the envelope generator EG1, so that the multiplier MLT5 adjust the amplitude of the envelope from the envelope generator EG1 in accordance with a value of the parameter Edge_EG_depth and passes the resultant amplitude-adjusted envelope to one input terminal of a second adder ADD2.

To another Input terminal of the second adder ADD2 is supplied a parameter Bias indicative of an FM feedback amount, and thus the adder ADD2 adds together values of the amplitude-adjusted envelope and parameter Bias and sends the added result to one input terminal of a sixth multiplier MLT6 as the parameter Edge_EG_depth. The output of the third multiplier MLT3 is coupled to a second low-pass filter LPF2. The second low-pass filter LPF2 is supplied with a parameter Ceiling indicative of an upper frequency limit of overtone components to be emphasized, so that in accordance with a value of the parameter Ceiling, the filter LPF2 filters out high-frequency components from the output signal given from the third multiplier MLT3 and then passes the filtered signal to one input terminal of a third adder ADD3. To another input terminal of the third adder ADD3 is a parameter Overtone for controlling overtone components; a greater value of the parameter Overtone will produce more even-numbered overtone components in an output signal Output.

The output of the third adder ADD3 is coupled to one input terminal of a fourth adder ADD4, and to another Input terminal of the fourth adder ADD4 is supplied an output from the sixth multiplier MLT6. The fourth adder ADD4 adds together the values received at the two input terminals and sends the resultant added result to a sine wave table TBL. Sine wave data is read out from the table TBL in accordance with the signal input thereto, which is then fed back through the sixth multiplier MLT6 and also supplied to a high-pass filter HPF.

The high-pass filter HPF is supplied with a parameter Highpass indicative of a cutoff frequency to filter out low-frequency components from a modulated signal, so that the filter HPF eliminates low-frequency components of the output signal given from the sine wave table TBL in accordance with the parameter Highpass and then sends the signal to a third low-pass filter LPF3. The parameter Highpass is also controlled in accordance with a tone pitch. The third low-pass filter LPF3 is supplied with a parameter Lowpass indicative of a cutoff frequency to filter out high-frequency components from a modulated signal, so that the filter LPF eliminates high-frequency components of the output signal from the high-pass filter HPF in accordance with the parameter Lowpass and then sends the signal to one input terminal of a fifth adder ADD5. The parameter Lowpass is also controlled in accordance with a tone pitch.

Envelope from a second envelope EG2 is applied to another input terminal of the fifth adder ADD5, which adds together the values received at the two input terminals and sends the resultant added result to a seventh multiplier MLT7. The seventh multiplier MLT7 is supplied with a parameter Wet indicative of an output level of a modulated signal, so that the multiplier MLT7 adjusts the amplitude of the output signal from the fifth adder ADD5 in accordance with a value of the parameter Wet and then sends the amplitude-adjusted signal to another input terminal of the first adder ADD1. Then, the first adder ADD1 adds together the output signals from the first multiplier MLT1 and first adder ADD1 and provides the resultant added result to the outside as an output signal Output.

Figure 20:
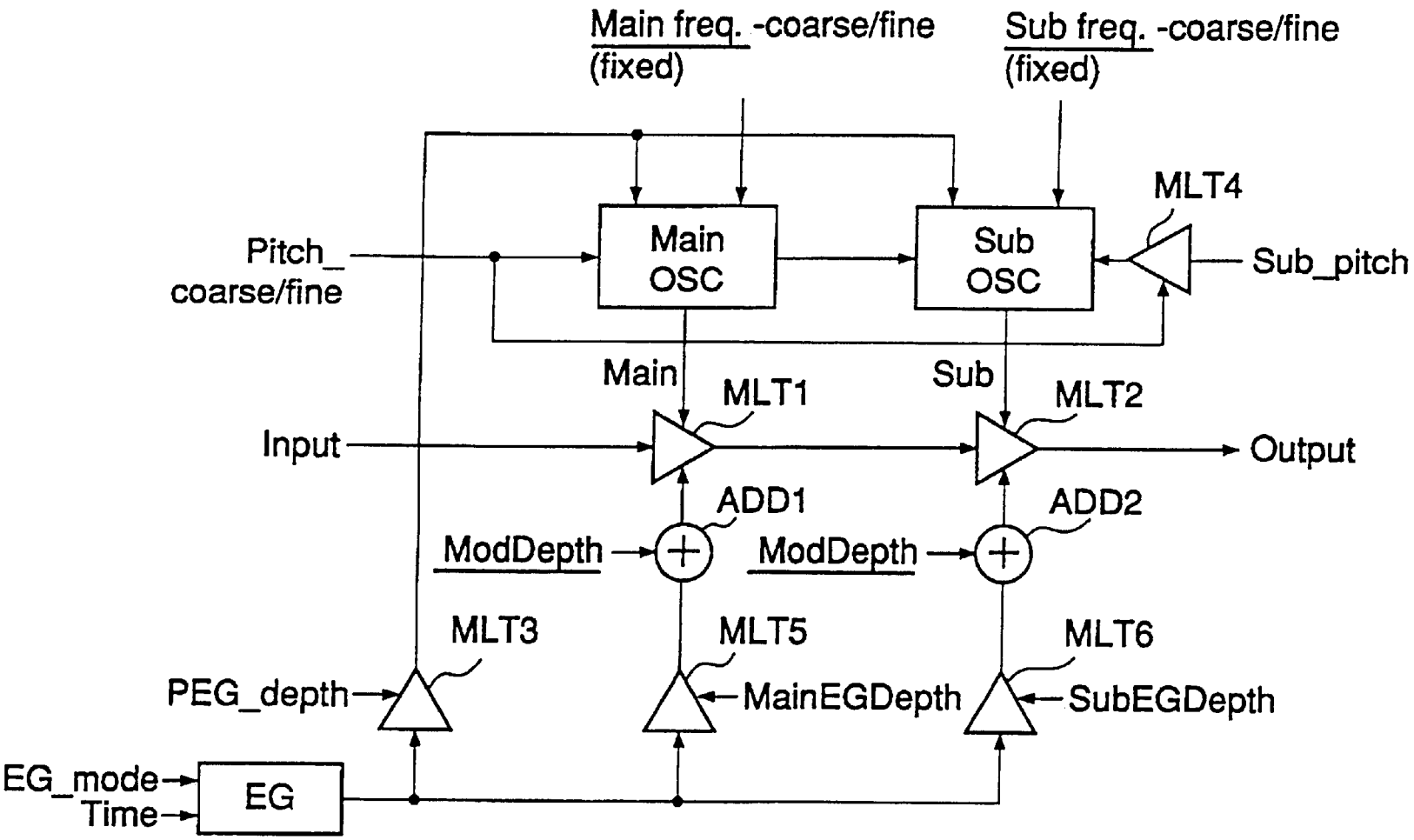
FIG. 20 is a block diagram explanatory of a process for imparting an effect produced by AM-modulating an input signal with a signal from an internal oscillator.

FIG. 20 is a block diagram explanatory of a process for imparting an effect produced by AM-modulating an input signal (modulated wave) with a signal from an internal oscillator, which specifically illustrates an effect algorithm therefor from a hardware point of view. According to the effect algorithm, a maximum degree of modulation (e.g., 200%) will lead to multiplication, which is equivalent to a so-called "ring modulator" and produces frequency components corresponding to a sum and difference between modulating and modulated waves. The frequency components of the modulated wave become prevalent as the degree of modulation decreases, and with a 0% modulation, there is left the modulated wave alone. The modulated wave is a sine wave according to the effect algorithm in the illustrated example, but more complex overtones may be imparted thereto by provision of a pair of main and subsidiary AM modulators.

In the illustrated example of FIG. 20, an input signal Input is supplied to one of three input terminals of a multiplier MLT1, and outputs from a main oscillator MainOSC and adder ADD1 are supplied to the other two input terminals of the multiplier MLT1. The output of the multiplier MLT1 is coupled to one of three input terminals of a second multiplier MLT2, and outputs from a subsidiary oscillator SubOSC and second adder ADD2 are supplied to the other two input terminals of the multiplier MLT2. The second multiplier MLT2 multiplies together the signals received at all of the three input terminals and provides the multiplied result to the outside as an output signal Output.

The main oscillator MainOSC is supplied with a parameter Pitch_coarse for setting a pitch of the modulating wave of the oscillator MainOSC, a parameter Pitch_fine for finely adjusting the pitch of the modulating wave of the oscillator MainOSC by the cent, a parameter Main_frequency_coarse indicative of a frequency offset of the modulating wave of the oscillator MainOSC and a parameter Main_frequency_fine for finely adjusting the parameter Main_frequency_coarse, as well as an output from a third multiplier MLT3.

Further, the subsidiary oscillator SubOSC is supplied with an output from a fourth multiplier MLT4, a parameter Sub_frequency_coarse indicative of a frequency offset of the modulating wave of the oscillator SubOSC and a parameter Sub_frequency_fine for finely adjusting the parameter Sub_frequency_coarse, as well as the output from the third multiplier MLT3. The above-mentioned parameters Pitch_coarse and Pitch_fine are fed to one input terminal of the fourth multiplier MLT4, while a parameter Sub_pitch, for setting a pitch of the modulating wave of the subsidiary oscillator SubOSC in a ratio to the pitch of the modulating wave of the main oscillator MainOSC, is fed to another input terminal of the fourth multiplier MLT4. Thus, the fourth multiplier MLT4 modifies the respective values of the parameters Pitch_coarse and Pitch_fine with the ratio of the parameter Sub_pitch and then passes the thus-modified values to the subsidiary oscillator SubOSC.

The third multiplier MLT3 is supplied with an envelope output from an envelope generator EG as well as a parameter PEG_depth for adjusting the output level of the multiplier MLT3, so that the multiplier MLT3 adjusts the amplitude of the envelope from the envelope generator EG in accordance with a value of the parameter PEG_depth and then sends the resultant amplitude-adjusted envelope to both the main oscillator MainOSC and the subsidiary oscillator SubOSC. The envelope output from the envelope generator EG is fed to fifth and sixth multipliers MLT5 and MLT6 as well. The fifth multiplier MLT5 is also supplied with a parameter Main_EG_depth for adjusting the output level of the multiplier MLT5, so that the multiplier MLT5 adjusts the amplitude of the envelope from the envelope generator EG in accordance with a value of the parameter Main_EG_depth and then sends the amplitude-adjusted result to one of the input terminals of the first adder ADD1. The sixth multiplier MLT6 is also supplied with a parameter Sub_EG_depth for adjusting the output level of the multiplier MLT6, so that the multiplier MLT6 adjusts the amplitude of the envelope from the envelope generator EG in accordance with a value of the parameter Sub_EG_depth and then sends the amplitude-adjusted result to one of the input terminals of the second adder ADD2.

The envelope generator EG is supplied with a parameter EG_mode indicative of an operating mode of the generator EG and a parameter Time indicative of an arrival time of an envelope, so that the generator EG generates an envelope on the basis of these parameters EG_mode and Time. Functions of these parameters EG_mode and Time are similar to those of the parameters EG_mode and Time already described in relation to FIG. 18 and will not be described here to avoid unnecessary duplication.

To the other input terminal of the first adder ADD1 is supplied a parameter Main_Mod_depth indicative of a modulation depth in the main oscillator MainOSC. To the other input terminal of the second adder ADD2 is supplied a parameter Sub_Mod_depth indicative of a modulation depth in the subsidiary oscillator SubOSC. Thus, the first adder ADD1 adds a value of the parameter Main_Mod_depth to the envelope adjusted in accordance with a value of the parameter Main_EG_depth and then sends the added result to the first multiplier MLT1, and similarly the second adder ADD2 adds a value of the parameter Sub_Mod_depth to the envelope adjusted in accordance with a value of the parameter Sub_EG_depth and then sends the added result to the second multiplier MLT2.

Figure 21:
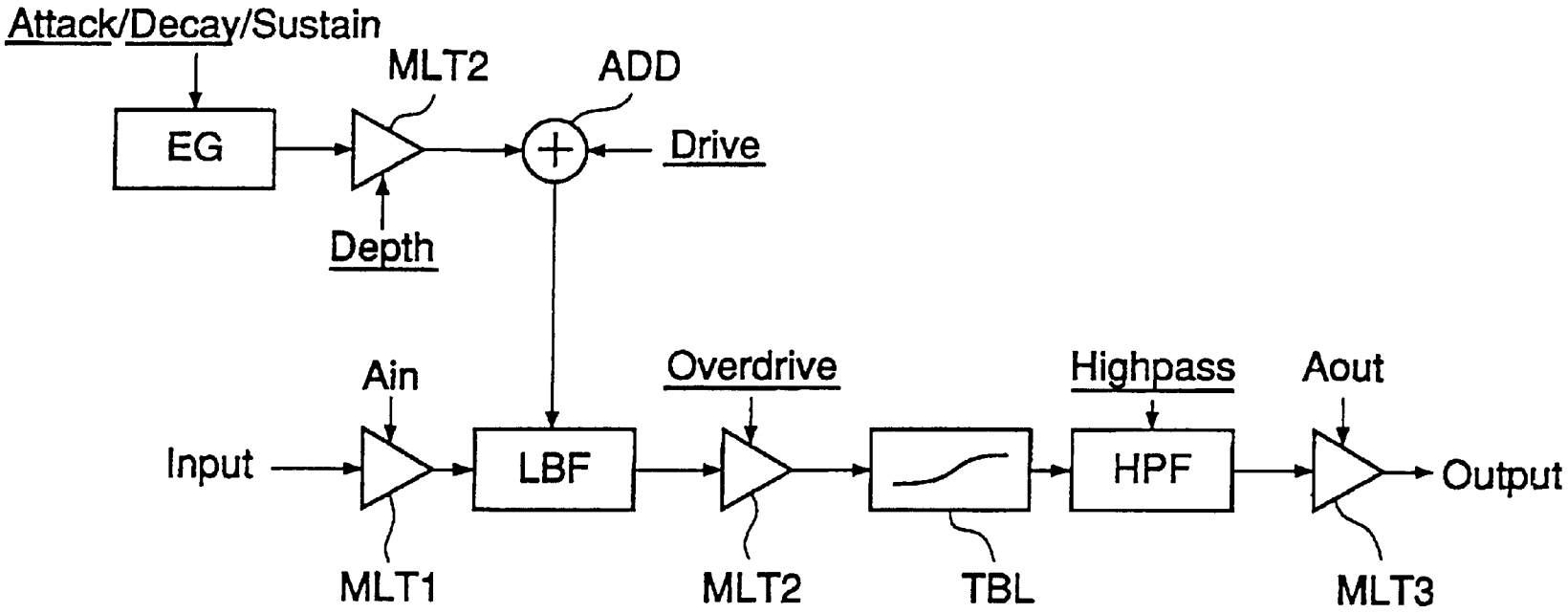
FIG. 21 is a block diagram explanatory of a process for imparting an effect produced by passing an input signal through a low-boost filter and then through an overdrive circuit.

FIG. 21 is a block diagram explanatory of a process for imparting an effect produced by passing an input signal through a low-boost filter and then through an overdrive circuit, which specifically illustrates an effect algorithm therefor from a hardware point of view. The effect algorithm allows a low boost amount to be controlled by an envelope generator EG, so that a particular tone can be controlled to become deeper but also an effect as achieved by a compressor can be imparted by, for example, emphasizing an attack portion. Because an overdrive effector can work on each individual note, it can produce a different effect from those made by other conventional effectors.

In the illustrated example of FIG. 21, an input signal Input is supplied to one input of a multiplier MLT1 while a parameter Ain indicative of a level of the input signal Input is supplied to another input of the multiplier MLT1, so that the multiplier MLT1 adjusts the amplitude of the input signal Input in accordance with a value of the parameter Ain and then sends the resultant amplitude-adjusted signal to a low-boost filter LBF. The low boost filter LBF is supplied with an output from an adder ADD. To two input terminals ADD are supplied a parameter Drive indicative of a low boost amount and an envelope output from an envelope generator EG after being adjusted in amplitude by a second multiplier HLT2. Thus, the adder ADD adds together values of the parameter Drive and envelope to thereby set an ultimate low boost amount and send the thus-set amount to the low-boost filter LBF.

The envelope generator EG is supplied with a parameter Attack indicative of an attack time of an envelope, a parameter Decay indicative of a decay time of the envelope and a parameter Sustain indicative of a stabilized level of the envelope, so that it generates an envelope on the basis of these parameters and passes the resultant generated envelope to the second multiplier MLT2. The second multiplier MLT2 adjusts the amplitude of the envelope from the envelope generator EG, in accordance with a value of a parameter EG_depth for adjusting the output level of the multiplier MLT2, and sends the resultant amplitude-adjusted envelope to the above-mentioned adder ADD.

The output of the low-boost filter LBF is coupled to one input terminal of the second multiplier MLT2, and a parameter Over-drive, indicative of an overdrive amount, is supplied to another input terminal of the second multiplier MLT2. Thus, the second multiplier MLT2 adjusts the amplitude of the output signal from the low-boost filter LBF in accordance with a value of the parameter Over-drive and then sends the resultant amplitude-adjusted output signal to a saturation table TBL which comprises table data of a characteristic such that the output signal value having exceeded a predetermined upper limit is caused to approach the upper limit while the output signal value having fallen below a predetermined lower limit is caused to approach the lower limit.

The saturation table TBL searches for table data corresponding to the input signal and then sends the searched result to a high-pass filter HPF. In accordance with a parameter Highpass indicative of a cutoff frequency to filter out low-frequency components, the high-pass filter HPF eliminates low-frequency components of the output signal given from the saturation table TBL and then sends the filtered signal to a third multiplier MLT3. The parameter Highpass is also controlled in accordance with a tone pitch. The third multiplier MLT3 is supplied with a parameter Aout indicative of an output level, so that the multiplier MLT3 adjusts the amplitude of the output signal from the high-pass filter HPF and provides the resultant amplitude-adjusted signal to the outside as an output signal Output.

The above-described embodiments are characterized primarily in that values of parameters used in the individual effect algorithms (some of the parameters values in the embodiment) are controlled in accordance with a tone pitch of an input signal (basic tone signal generated by the first or second wave DSP 161 or 163), i.e., for each note. This characteristic arrangement achieves a further increased variety of effect to be imparted to tones. In each of the above-described embodiments, a tone pitch designated via the keyboard or the like may be time-varied by means of a pitch bend operator, after-key-touch detection data or the like so that an effect parameter is time-varied in accordance with the thus-varied designated tone pitch.

Whereas the signal processing arrangements as shown in FIG. 10 and FIGS. 12 to 21 are hardware circuit representation of various signal processing algorithms executed by a DSP, these signal processing may be executed by a general-purpose microprocessor, such as the above-mentioned CPU 5, in place of the DSP. Alternatively, the signal processing arrangements may be implemented actually by hardware as illustrated in the figures.

It should also be obvious that the objects of the present invention may also be accomplished by providing the system or device with a recording medium containing a software program capable of performing the functions of the above-described embodiments and allowing a computer (or CPU 5 or MPU) of the system or device to read out and execute the program. In this case, the program read out from the recording medium will itself implement the novel functions, i.e., novel features, of the present invention.

The recording medium for storing the program may, for example, be a hard disk installed in the above-mentioned HDD 11, CD-ROM 21, MO, MD, floppy disk 20, CD-R (CD-Recordable), magnetic tape, non-volatile memory card or ROM. As an alternative, the inventive program may be supplied from the other MIDI instrument 100 or from the server computer 102 via the communication network 101.

Further, according to the present invention, the functions of the above-described embodiments may be performed by an operating system (OS), working on a computer, executing part or all of the processes on the basis of the program instructions, in stead of the computer executing the read-out program.

It should also be obvious that the program read out from the recording medium may be written into a memory on a function extension card inserted in the computer or a function extension unit attached to the computer so that a CPU or the like on the function extension card or function extension unit executes part or all of the processes on the basis of the program instructions to thereby perform the functions of the above-described embodiments.

In summary, the present invention as has been described so far is characterized in that a basic tone waveform is generated in accordance with a designated tone color and pitch and an effect algorithm corresponding to the designated tone color is executed to impart an effect based on the algorithm to the basic tone waveform. This arrangement achieves an increased variety of effect. Further, in an preferred implementation where the effect algorithm is controlled in accordance with the designated tone pitch, it is possible to achieve a further increased variety of effect.

What is claimed is:

1. A tone synthesizing device comprising:

a tone designating section that designates a tone color and pitch of a tone to be generated;

a basic tone waveform generator section that is capable of generating, in each of a plurality of channels, a basic tone waveform corresponding to the tone color and pitch designated by said tone designating section;

an effect imparting section that imparts an effect to the basic tone waveform in accordance with an effect algorithm corresponding to the designated tone color, independently for each of the channels, wherein said effect algorithm includes a delay component; and a control section that controls the effect, to be imparted by said effect imparting section, separately for each of the channels, said control section, for each of the channels, generating a unique effect control parameter in accordance with at least the designated tone pitch and controlling the effect for said channel in accordance with the effect control parameter generated thereby, wherein said control parameter controls a delay characteristic in said delay component in accordance with the designated tone pitch.

2. A tone synthesizing device as recited in claim 1 wherein said effect imparting section includes a plurality of processing systems and is capable of designating a tone color separately for each of the processing systems, and each of the processing systems includes a plurality of effect imparting channels, and wherein the basic tone waveform of a given channel generated by said basic tone waveform generator section is delivered to one of the effect imparting channels which corresponds to the tone color of the basic tone waveform, and the one effect imparting channel, to which the basic tone waveform is delivered, controls the effect, based on the effect algorithm corresponding to the designated tone color, in accordance with a characteristic corresponding to at least the tone pitch of the basic tone waveform.

3. A tone synthesizing device as recited in claim 1 wherein said effect imparting section includes a processor that executes a predetermined program containing the effect algorithm corresponding to the designated tone color.

4. A tone synthesizing device as recited in claim 3 wherein said predetermined program is selected from among a plurality of programs corresponding to a plurality of effect algorithms, depending on the designated tone color.

5. A tone synthesizing device as recited in claim 3 wherein said effect imparting section is capable of executing different ones of the programs, corresponding to a plurality of different effects, simultaneously in a parallel fashion.

6. A tone synthesizing device as recited in claim 1 wherein said tone designating section includes variable control means that variably controls the designated tone pitch with passage of time, and said control section generates the effect control parameter that is varied in accordance with the designated tone pitch variably controlled by said variable control means.

7. A tone synthesizing device comprising:

a tone designating section that designates a tone color and pitch of a tone to be generated;

a basic tone waveform generator section that is capable of generating, in each of a plurality of channels, a basic tone waveform corresponding to the tone color and pitch designated by said tone designating section;

an effect imparting section that imparts an effect to the basic tone waveform in accordance with an algorithm for providing a predetermined effect, independently for each of the channels; and a control section that controls the effect, to be imparted by said effect imparting section, separately for each of the channels, wherein said algorithm includes a delay element that delays an input exciting signal, and in order to impart an effect specific to an electromagnetic pickup of an electric guitar, said algorithm modifies a delay amount in said delay element in accordance with an assumed picking position and an assumed position of the electromagnetic pickup and controls the assumed picking position and assumed position of the electromagnetic pickup in accordance with the designated tone pitch.

8. A tone synthesizing device as recited in claim 7 wherein as the input exciting signal, the basic tone waveform generated by said basic tone waveform generator section is supplied to said delay element.

9. A tone synthesizing device as recited in claim 7 wherein said algorithm includes a comb filter and said delay element is a delay element of said comb filter.

10. A tone synthesizing device as recited in claim 9 wherein said comb filter includes said delay element, a feedforward path having a signal-gain controlling element, and an element that synthesizes output signals from said delay element and said feedforward path, and wherein said signal-gain controlling element in said feedforward path is also capable of controlling polarity of a signal gain.

11. A tone synthesizing device comprising:

a tone designating section that designates a tone color and pitch of a tone to be generated;

a basic tone waveform generator section that is capable of generating, in each of a plurality of channels, a basic tone waveform corresponding to the tone color and pitch designated by said tone designating section;

an effect imparting section that imparts an effect to the basic tone waveform in accordance with an algorithm for providing a predetermined effect, independently for each of the channels; and a control section that controls the effect, to be imparted by said effect imparting section, separately for each of the channels, wherein said algorithm generates a random signal to control a cutoff frequency on the basis of the random signal, filters the basic tone waveform generated by said basic tone waveform generator section in accordance with the controlled cutoff frequency, supplies the filtered basic tone waveform to a delay element, and controls a delay amount in said delay element in accordance with the designated tone pitch.

12. A tone synthesizing device as recited in claim 11 wherein said delay element constitutes a delay loop.

13. A tone synthesizing method comprising:

a step of designating a tone color and pitch of a tone to be generated;

a step capable of generating, in each of a plurality of channels, a basic tone waveform corresponding to the tone color and pitch designated by said step of designating;

a step of imparting an effect to the basic tone waveform in accordance with an effect algorithm corresponding to the designated tone color, independently for each of the channels, wherein said algorithm contains a delay component; and a step of controlling the effect, to be imparted by said step of imparting, separately for each of the channels, generating a unique effect control parameter in accordance with the designated tone pitch and controlling the effect for each of the channels in accordance with the effect control parameter generated thereby, wherein said control parameter controls a delay characteristic in said delay component in accordance with the designated tone pitch.

14. A tone synthesizing method comprising:

a step of designating a tone color and pitch of a tone to be generated;

a step capable of generating, in each of a plurality of channels, a basic tone waveform corresponding to the tone color and pitch designated by said step of designating;

a step of imparting an effect to the basic tone waveform in accordance with an algorithm for providing a predetermined effect, independently for each of the channels; and a step of controlling the effect, to be imparted by said step of imparting, separately for each of the channels, wherein said algorithm includes a delay element that delays an input exciting signal, and in order to impart an effect specific to an electromagnetic pickup of an electric guitar, said algorithm modifies a delay amount in said delay element in accordance with an assumed picking position and an assumed position of the electromagnetic pickup and controls the assumed picking position and assumed position of the electromagnetic pickup in accordance with the designated tone pitch.

15. A tone synthesizing method comprising:

a step of designating a tone color and pitch of a tone to be generated;

a step capable of generating, in each of a plurality of channels, a basic tone waveform corresponding to the tone color and pitch designated by said step of designating;

a step of imparting an effect to the basic tone waveform in accordance with an algorithm for providing a predetermined effect, independently for each of the channels; and a step of controlling the effect, to be imparted by said step of imparting, separately for each of the channels, wherein said algorithm generates a random signal to control a cutoff frequency on the basis of the random signal, filters the basic tone waveform generated by said step capable of generating in accordance with the controlled cutoff frequency, supplies the filtered basic tone waveform to a delay element, and controls a delay amount in said delay element in accordance with the designated tone pitch.

16. A machine-readable recording medium containing a group of instructions of a program to be executed by a computer for synthesizing a tone and imparting an effect to the tone, said program comprising:

a step of designating a tone color and pitch of a tone to be generated;

a step capable of generating, in each of a plurality of channels, a basic tone waveform corresponding to the tone color and pitch designated by said step of designating;

a step of imparting an effect to the basic tone waveform in accordance with an effect algorithm corresponding to the designated tone color, independently for each of the channels, wherein said algorithm contains a delay component; and a step of controlling the effect, to be imparted by said step of imparting, separately for each of the channels, generating a unique effect control parameter in accordance with the designated tone pitch and controlling the effect for each of the channels in accordance with the effect control parameter generated thereby, wherein said control parameter controls a delay characteristic in said delay component in accordance with the designated tone pitch.

17. A machine-readable recording medium containing a group of instructions of a program to be executed by a computer for synthesizing a tone and imparting an effect to the tone, said program comprising:

a step of designating a tone color and pitch of a tone to be generated;

a step capable of generating, in each of a plurality of channels, a basic tone waveform corresponding to the tone color and pitch designated by said step of designating;

a step of imparting an effect to the basic tone waveform in accordance with an algorithm for providing a predetermined effect, independently for each of the channels; and a step of controlling the effect, to be imparted by said step of imparting, separately for each of the channels, wherein said algorithm includes a delay element that delays an input exciting signal, and in order to impart an effect specific to an electromagnetic pickup of an electric guitar, said algorithm modifies a delay amount in said delay element in accordance with an assumed picking position and an assumed position of the electromagnetic pickup and controls the assumed picking position and assumed position of the electromagnetic pickup in accordance with the designated tone pitch.

18. A machine-readable recording medium containing a group of instructions of a program to be executed by a computer for synthesizing a tone and imparting an effect to the tone, said program comprising:

a step of designating a tone color and pitch of a tone to be generated;

a step capable of generating, in each of a plurality of channels, a basic tone waveform corresponding to the tone color and pitch designated by said step of designating;

a step of imparting an effect to the basic tone waveform in accordance with an algorithm for providing a predetermined effect, independently for each of the channels; and a step of controlling the effect, to be imparted by said step of imparting, separately for each of the channels, wherein said algorithm generates a random signal to control a cutoff frequency on the basis of the random signal, filters the basic tone waveform generated by said step capable of generating in accordance with the controlled cutoff frequency, supplies the filtered basic tone waveform to a delay element, and controls a delay amount in said delay element in accordance with the designated tone pitch.

* * * * *